US007701149B2

(12) United States Patent
Lin

(10) Patent No.: US 7,701,149 B2
(45) Date of Patent: Apr. 20, 2010

(54) MULTIPHASE VOLTAGE SOURCES DRIVEN AC_LED

(75) Inventor: Ming-Te Lin, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 11/564,230

(22) Filed: Nov. 28, 2006

(65) Prior Publication Data

US 2007/0133230 A1 Jun. 14, 2007

(30) Foreign Application Priority Data

Dec. 9, 2005 (TW) ..... 94143520
Nov. 20, 2006 (TW) ..... 95142757

(51) Int. Cl.
*H05B 37/02* (2006.01)

(52) U.S. Cl. ..... 315/307; 315/247; 315/294

(58) Field of Classification Search ..... 315/161, 315/169.3, 185 S, 185 R, 200 R, 312, 247, 315/291, 294, 297, 299, 307–309; 362/227, 362/252, 800, 806, 812; 345/39, 46, 82
See application file for complete search history.

(56) References Cited

U.S. PATENT DOCUMENTS 5,936,599 A * 8/1999 Reymond ..... 345/82
6,185,115 B1 * 2/2001 Sul et al. ..... 363/37
6,490,187 B2 * 12/2002 Mori et al. ..... 363/147
6,577,072 B2 * 6/2003 Saito et al. ..... 315/185 R
6,894,442 B1 * 5/2005 Lim et al. ..... 315/291
7,081,722 B1 * 7/2006 Huynh et al. ..... 315/323
2004/0047151 A1 * 3/2004 Bogner et al. ..... 362/236
2004/0095099 A1 5/2004 Salama
2006/0133078 A1 * 6/2006 Peng ..... 362/231
2006/0138971 A1 * 6/2006 Uang et al. ..... 315/291
2006/0198143 A1 * 9/2006 Cheung ..... 362/251
2007/0114951 A1 * 5/2007 Tsen et al. ..... 315/291
2007/0278502 A1 * 12/2007 Shakuda et al. ..... 257/88

FOREIGN PATENT DOCUMENTS

CN 2754308 1/2006
CN 1757267 4/2006
CN 2006101633098 12/2008

OTHER PUBLICATIONS

"2nd Office Action of China Counterpart Application", issued on Nov. 13, 2009, p1-p11.

* cited by examiner

*Primary Examiner*—David Hung Vu
*Assistant Examiner*—Tung X Le
(74) *Attorney, Agent, or Firm*—Jiang Chyun IP Office

(57) ABSTRACT

Multiphase voltage sources are used in driving an AC_LED; different light timing is achieved by changing the relative phase or frequency of the voltage sources. Different light color mixing is also achieved when more than one AC_LED with different colors are combined to use.

19 Claims, 25 Drawing Sheets

MULTIPHASE VOLTAGE SOURCES DRIVEN AC_LED

BACKGROUND OF THE INVENTION

1. Field of the Invention

The present invention relates to a light timing controlling method and device for an AC_LED, and more particularly, to a method and device for controlling light timing of an AC_LED by multiphase voltage sources.

2. Description of the Prior Art

FIGS. 1A to 1D show a traditional AC_LED driven by a single-phase voltage source.

FIG. 1A shows a traditional controlling system for an AC_LED. A traditional AC_LED 10 is electrically coupling to a single-phase voltage source, for example, a nominal voltage of AC 110V. The AC_LED used in this invention is triggered by 90V as an example. An AC_LED 10 is composed of two DC_LEDs being electrically coupling with each other in electrically reverse direction. FIG. 1A shows that two DC_LEDs are arranged in a reversed direction, so that the two DC_LEDs are connected head to tail with shortest metal wires. The positive terminal of the first DC_LED (positive DC_LED) is connected to the negative terminal of the second DC_LED (negative DC_LED), and the negative terminal of the first DC_LED is connected to the positive terminal of the second DC_LED. The AC_LED 10 turns on when the supplied voltage reaches the trigger voltage, for example, 90V as exemplified in the invention. The first or positive DC_LED turns on when the voltage is above +90V, and turns off when the voltage falls down below 90V, The second or negative DC_LED turns on when the voltage is below −90V and the negative DC_LED turns off when the voltage rises above −90V.

FIG. 1B shows a traditional voltage waveform disclosed in the prior art. The abscissa shows a voltage phase with a scale of 0~360 degree. The ordinate shows voltage with a scale of −200V~+200V. The nominal 110V is a root-mean-square (RMS) of actual voltage supplied. In other words, a nominal 110V power source actually fluctuates in between −156V~+156V. The voltage peak (Vp) is calculated as follows:

$$Vp=1.414\times RMS=1.414\times 110V=156V$$

FIG. 1B shows a sine waveform of a nominal 110V power source, disclosing a voltage of 0V at phase 0 degree, a positive voltage peak of +156V at phase 90 degree, a voltage of 0V at phase 180 degree, a negative voltage peak of −156V at phase 270 degree, and a voltage of 0V at phase 360 degree.

FIG. 1C shows a traditional current waveform disclosed in the prior art. The abscissa shows a voltage phase with a scale of 0~360 degree. The ordinate shows current with a scale of −6.0 mA~+6.0 mA. The traditional current waveform of FIG. 1C indicates a current of 0 mA at phase 0~30 degree with voltage higher than 90V at phase higher than 30 degree where the positive DC_LED is triggered to turn on, a positive current peak of +5.2 mA at phase 90 degree, a current of 0 mA at phase 150~210 degree where the positive DC_LED is turned off due to voltage falls down below the trigger voltage 90V, and the positive DC_LED is turned on during phase 30~150 degree and turned off in the remaining period. Conversely, as shown in FIG. 1C, the voltage is lower than 90V at phase 210 degree where the negative DC_LED is triggered to turn on; there is a current peak of +5.2 mA at phase 270 degree; the voltage rises higher than −90V, and the negative DC_LED is turned off. In summary, the positive AC_LED turns on during phase 30~150 degree and turns off during the remaining period, and the negative DC_LED turns on during phase 210~330 degree and turned off in the remaining period.

FIG. 1D shows a traditional power waveform disclosed in the prior art. The abscissa shows voltage phase with a scale of 0~360 degree. The ordinate shows power with a scale of 0.0 W~1.0 W. The traditional power waveform of FIG. 1D indicates a power of 0 W at phase 0~30 degree, a power peak of 0.8 W at phase 90 degree, a power of 0 W at phase 150~210 degree, a power peak of 0.8 W at phase 270 degree, and a power of 0 W at phase 330~360 degree.

The prior art disclosing single-phase voltage source-based control lacks flexibility in light timing because of its fixed and unchangeable power cycle. The prior art fails to meet the need for a variety of light timing of the AC_LED.

SUMMARY OF THE INVENTION

In light of the aforesaid drawbacks of the prior art, it is a primary objective of the present invention to provide a method and system for an AC_LED to which the light timing is changeable through multiphase voltage sources control.

Another objective of the present invention is to provide a method and system for outputting different mixed light color in a wide range through a combination use of AC_LEDs with different color under multiphase voltage sources control.

Yet another objective of the present invention is to provide a method and system for changing the light timing of an AC_LED through changing the phase or frequency of one of the voltage sources supplied.

BRIEF DESCRIPTION OF THE DRAWINGS

FIG. 1A (PRIOR ART) shows a traditional control system;

FIG. 1B (PRIOR ART) shows a traditional voltage waveform;

FIG. 1C (PRIOR ART) shows a traditional current waveform;

FIG. 1D (PRIOR ART) shows a traditional power waveform;

FIG. 2A shows a control system;

FIG. 2B shows a voltage waveform;

FIG. 2C shows a voltage difference waveform;

FIG. 2D shows a current waveform;

FIG. 2E shows a power waveform;

FIG. 3A shows a voltage waveform;

FIG. 3B shows a voltage difference waveform;

FIG. 3C shows a current waveform;

FIG. 3D shows a power waveform;

FIG. 4A shows a voltage waveform;

FIG. 4B shows a voltage difference waveform;

FIG. 4C shows a current waveform;

FIG. 4D shows a power waveform;

FIG. 7A shows a control system;

FIG. 7B shows a voltage waveform;

FIG. 7C shows a voltage difference waveform;

FIG. 7D shows a current waveform;

FIG. 7E shows a power waveform;

FIG. 8A shows a voltage waveform;

FIG. 8B shows a voltage difference waveform;

FIG. 8C shows a current waveform;

FIG. 8D shows a power waveform;

FIG. 9A shows a control system;

FIG. 9B shows a voltage waveform;

FIG. 9C shows a voltage difference waveform;

FIG. 9D shows a current waveform;

FIG. 9E shows a power waveform;

FIG. 10A shows a voltage waveform;

FIG. 10B shows a voltage difference waveform;

FIG. 10C shows a current waveform;

FIG. 10D shows a power waveform;

FIG. 13A shows a triangle voltage waveform;

FIG. 13B shows a voltage difference waveform;

FIG. 13C shows a current waveform;

FIG. 13D shows a power waveform;

FIG. 14A shows a characterized voltage waveform;

FIG. 14B shows a voltage difference waveform;

FIG. 14C shows a current waveform; and

FIG. 14D shows a power waveform.

DETAILED DESCRIPTION OF THE PREFERRED EMBODIMENTS

FIGS. 2A to 2E show an AC_LED driven by two voltage sources with a phase difference of 40 degree of the first embodiment of the present invention.

Figure 1A:
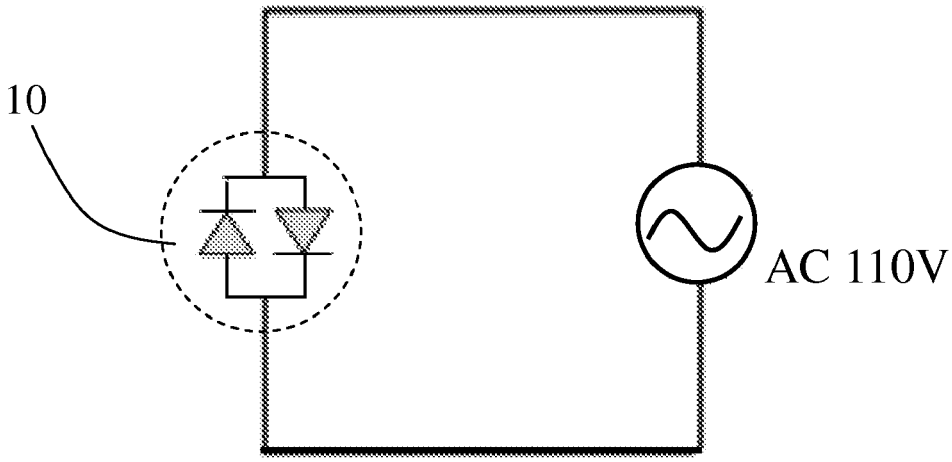
Fig. 1A. Prior Art
FIGS. 1A to 1D (PRIOR ART) show an AC_LED driven by a single phase voltage source in a traditional way.
Figure 1B:
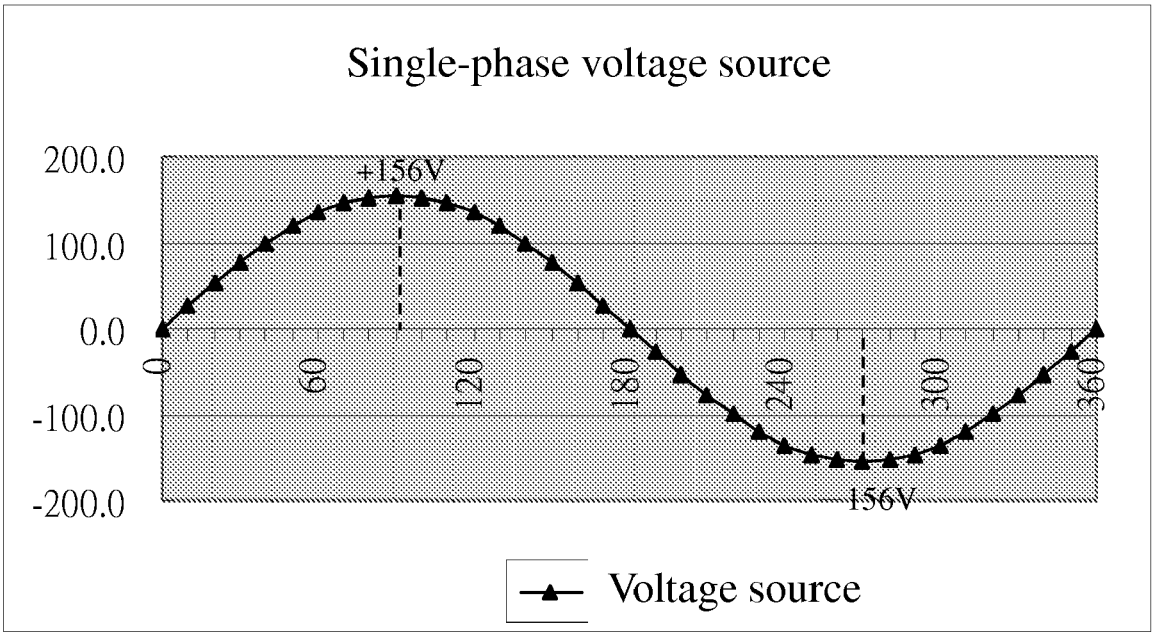
Fig. 1B. Prior Art
Figure 1C:
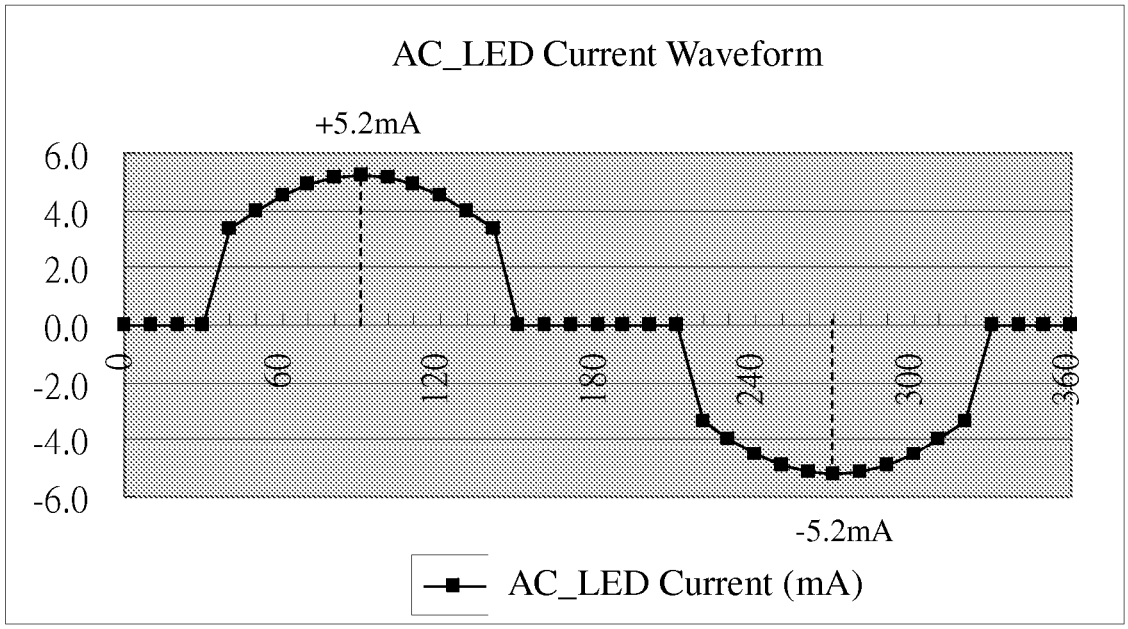
Fig. 1C. Prior Art
Figure 1D:
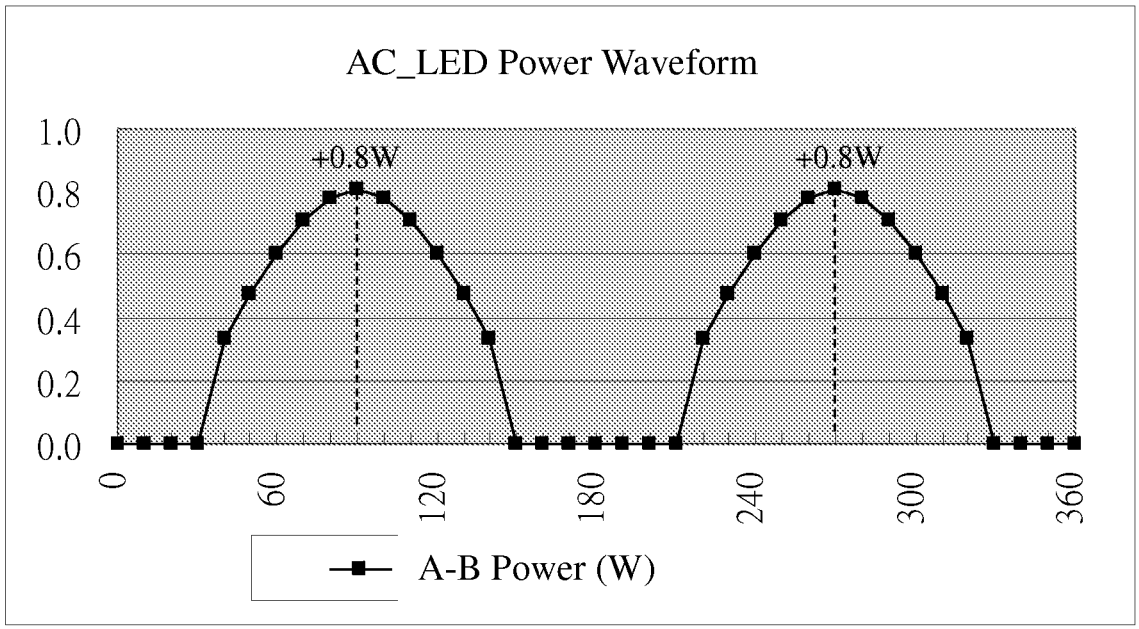
Fig. 1D. Prior Art
Figure 2A:
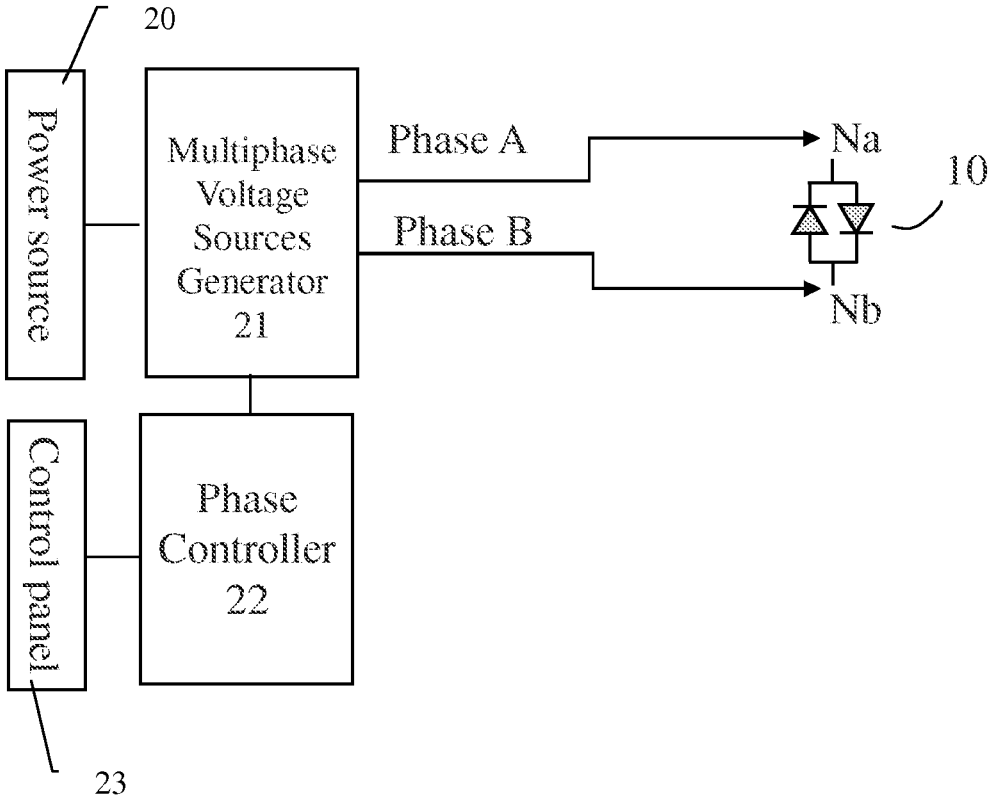
FIGS. 2A to 2E show a first embodiment of an AC_LED driven by two voltage sources with a phase difference of 40 degree.

Referring to FIG. 2A, which shows an AC_LED driven by two voltage sources at different phases. An AC_LED 10 has a first terminal electrically coupling to node Na, and has a second terminal electrically coupling to node Nb. A multiphase voltage sources generator 21 modifies the input power from a power source 20 and outputs two voltage sources at phase A and phase B respectively. Phase A and phase B are then electrically coupled to node Na and node Nb respectively for driving the AC_LED 10.

Alternatively, a voltage phase controller 22 coupled to the multiphase voltage sources generator 21 is provided, so as to adjust the voltage phase of each voltage source output to control the light timing of the AC_LED 10. Furthermore, a control panel 23 can be alternatively included to couple to the phase controller 22 for the end user to set the voltage phase for each of the voltage sources.

Furthermore, a frequency adjuster can also be included (not shown) to couple to the multiphase voltage sources generator 21 for the end user to adjust the frequency of each of the voltage sources output respectively to node Na and node Nb.

Figure 2B:
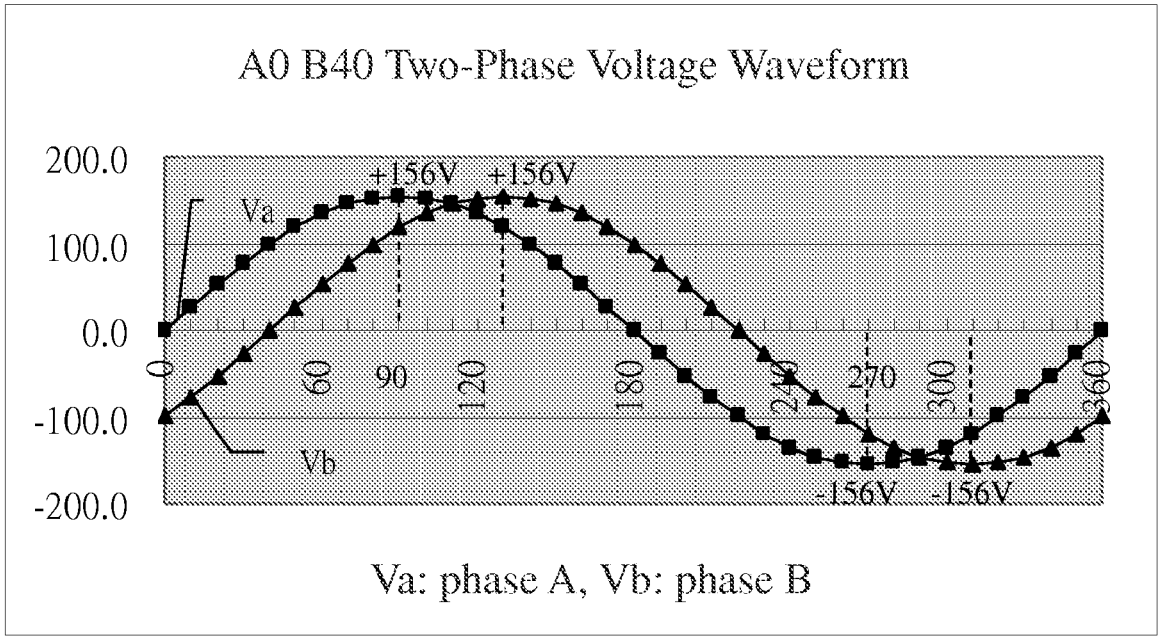

Referring to FIG. 2B, which shows a voltage waveform with a phase lag of 40 degree. The abscissa shows voltage phase with a scale of 0~360 degree. The ordinate shows voltage with a scale of −200V~+200V. Curve Va shows the voltage waveform at node Na. Curve Vb shows the voltage waveform at node Nb. Curve Vb has a 40 degree phase lag than curve Va. Curve Va has a positive voltage peak of +156V at phase 90 degree and a negative voltage peak of −156V at phase 270 degree. Curve Vb has a positive voltage peak of +156V at phase 130 degree and a negative voltage peak of −156V at phase 310 degree.

Figure 2C:
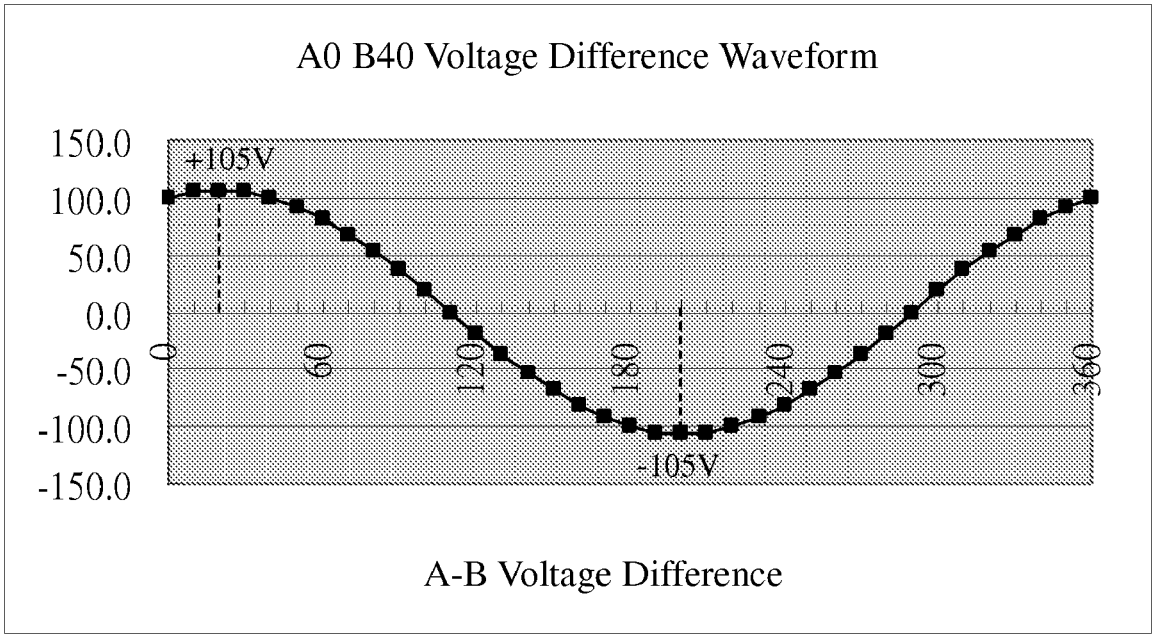

Referring to FIG. 2C, which shows a voltage difference waveform. The abscissa shows a voltage phase with a scale of 0~360 degree. The ordinate shows a voltage difference with a scale of −150V~+150V and indicates a positive voltage difference peak of +105V at phase 20 degree, a negative voltage difference peak of −105V at phase 200 degree, and a voltage difference of 0V at phases 110 degree and 290 degree.

Figure 2D:
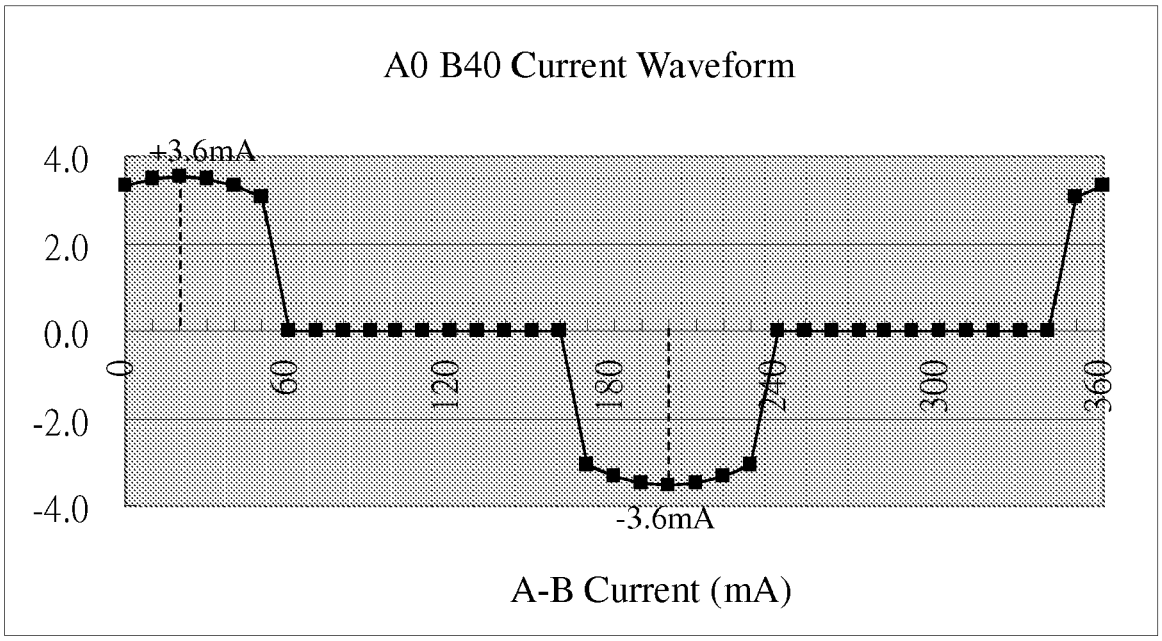

Referring to FIG. 2D, which shows a current waveform. The abscissa shows voltage phase with a scale of 0~360 degree. The ordinate shows current with a scale of −4.0 mA~+4.0 mA. FIG. 2D shows the positive DC_LED turns on to shine at phase 0~60 degree and 340~360 degree. The negative DC_LED turns on to shine at phase 160~240 degree. There is a positive current peak of +3.6 mA at phase 20 degree, and a negative current peak of −3.6 mA at phase 200 degree. Neither the positive DC_LED nor the negative DC_LED illuminates at phase 60~160 degree and 240~340 degree; in other words, both the positive DC_LED and the negative DC_LED turn off during these periods.

Figure 2E:
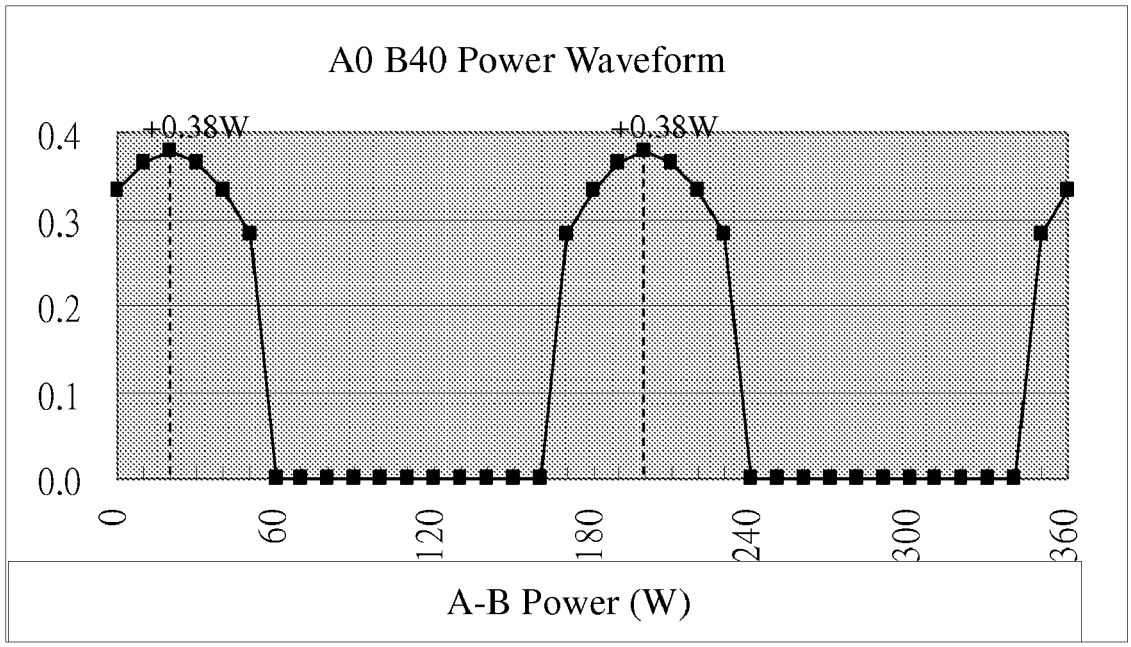

Referring to FIG. 2E, which shows a power waveform. The abscissa shows a voltage phase with a scale of 0~360 degree. The ordinate shows power with a scale of 0.0 W~0.4 W, indicating a power peak of 0.38 W at phase 20 degree and 200 degree for the positive DC_LED and negative DC_LED respectively, and a power of 0 W at phases 60~160 degree and 240~340 degree.

FIGS. 3A to 3D show an AC_LED driven by two voltage sources with a phase difference of 90 degree of the second embodiment of the present invention.

Figure 3A:
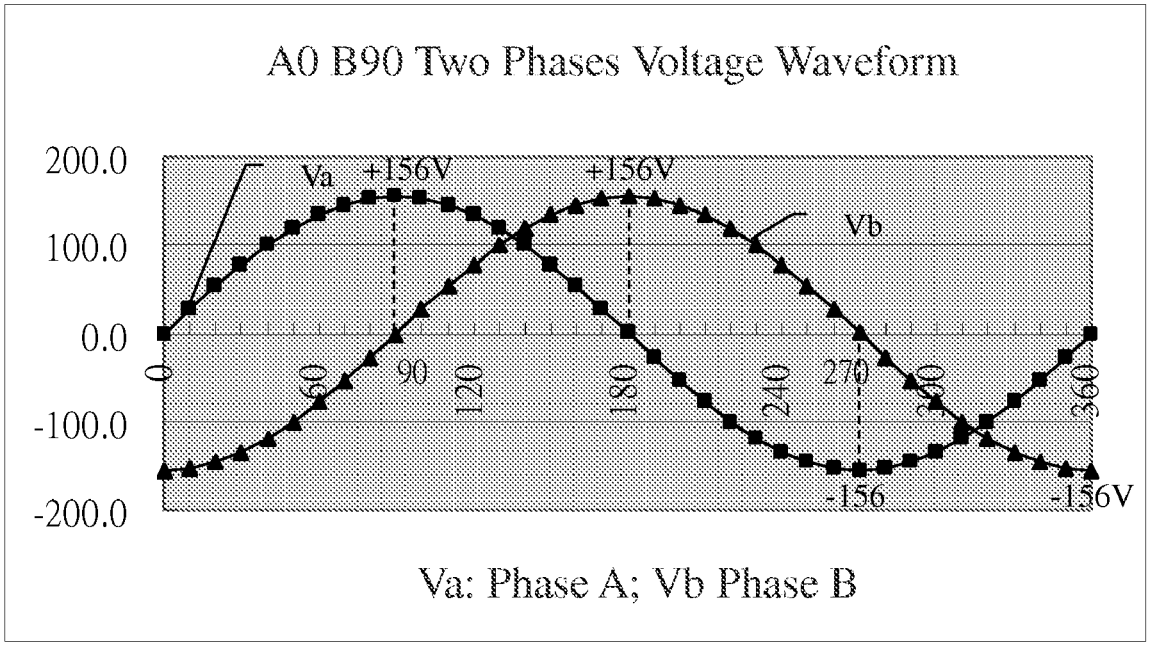
FIGS. 3A to 3D show a second embodiment of an AC_LED driven by two voltage sources with a phase difference of 90 degree.

Referring to FIG. 3A, which shows a voltage waveform with a phase lag of 90 degree. The abscissa shows a voltage phase with a scale of 0~360 degree. The ordinate shows voltage with a scale of −200V~+200V. Curve Va shows the voltage waveform at node Na. Curve Vb shows the voltage waveform at node Nb. Curve Vb lags curve Va in phase by 90 degree. Curve Va has a positive voltage peak of +156V at phase 90 degree and a negative voltage peak of −156V at phase 270 degree. Curve Vb has a positive voltage peak of +156V at phase 180 degree and a negative voltage peak of −156V at phase 360 degree.

Figure 3B:
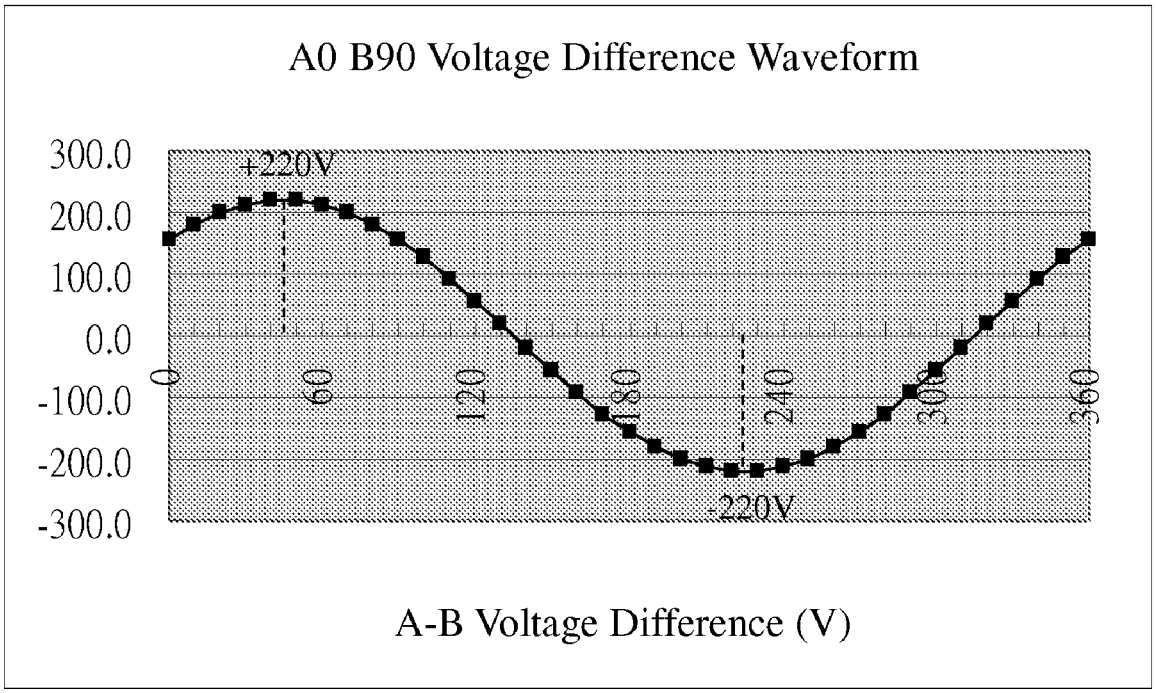

Referring to FIG. 3B, which shows a voltage difference waveform between node Na and node Nb. The abscissa shows a voltage phase with a scale of 0~360 degree. The ordinate shows a voltage difference with a scale of −300V~+300V, indicating a positive voltage difference peak of +220V at phase 45 degree, a negative voltage difference peak of −220V at phase 225 degree, and a voltage difference of 0V at phase 135 degree and 315 degree.

Figure 3C:
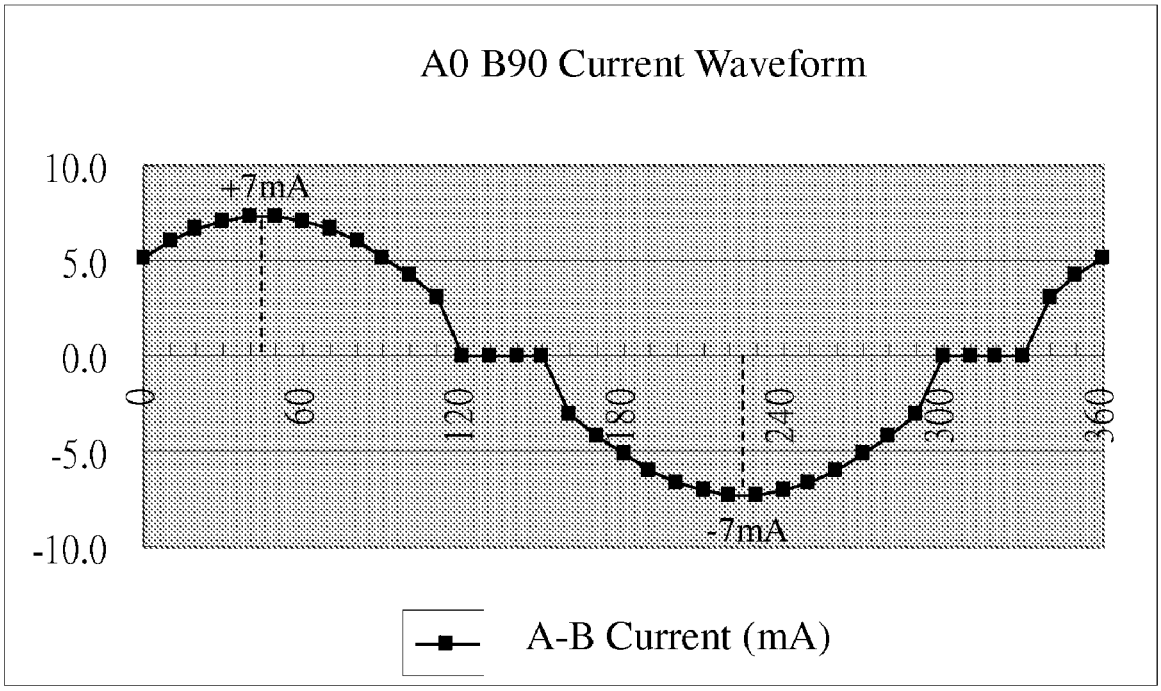

Referring to FIG. 3C, which shows a current waveform. The abscissa shows a voltage phase with a scale of 0~360 degree. The ordinate shows current with a scale of −10.0 mA~+10.0 mA. FIG. 3C shows that the positive DC_LED turns on to shine at phase 0~120 degree and 340~360 degree, and that the negative DC_LED turns on to shine at phase 150~300 degree. FIG. 3C shows a positive current peak of +7 mA at phase 45 degree, and a negative current peak of −7 mA at phase 225 degree. Neither the positive DC_LED nor the negative DC_LED illuminates at phase 120~150 degree and 300~330 degree; in other words, both the positive DC_LED and the negative DC_LED turns off during these periods.

Figure 3D:
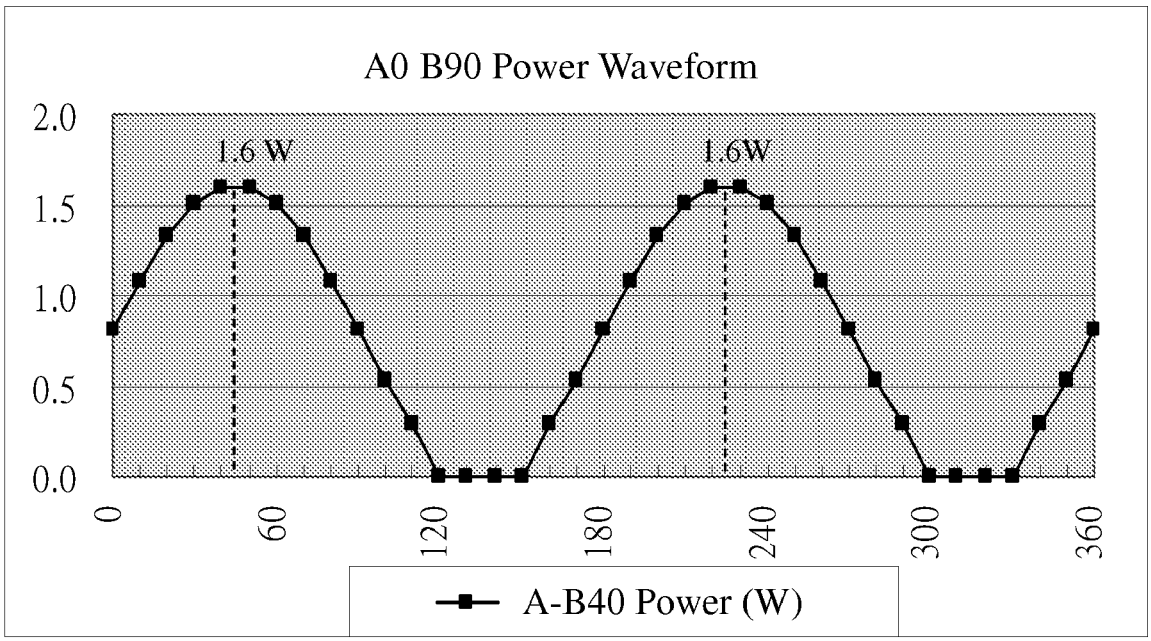

Referring to FIG. 3D, which shows a power waveform. The abscissa shows a voltage phase with a scale of 0~360 degree. The ordinate shows power with a scale of 0.0 W~2.0 W, indicating a power peak of 1.6 W at phase 45 degree and 225 degree for the positive DC_LED and negative DC_LED respectively. The power is 0 W at phase 120~150 degree and 300~330 degree.

FIGS. 4A to 4D show an AC_LED driven by two voltage sources with a phase difference of 180 degree of the third embodiment of the present invention.

Figure 4A:
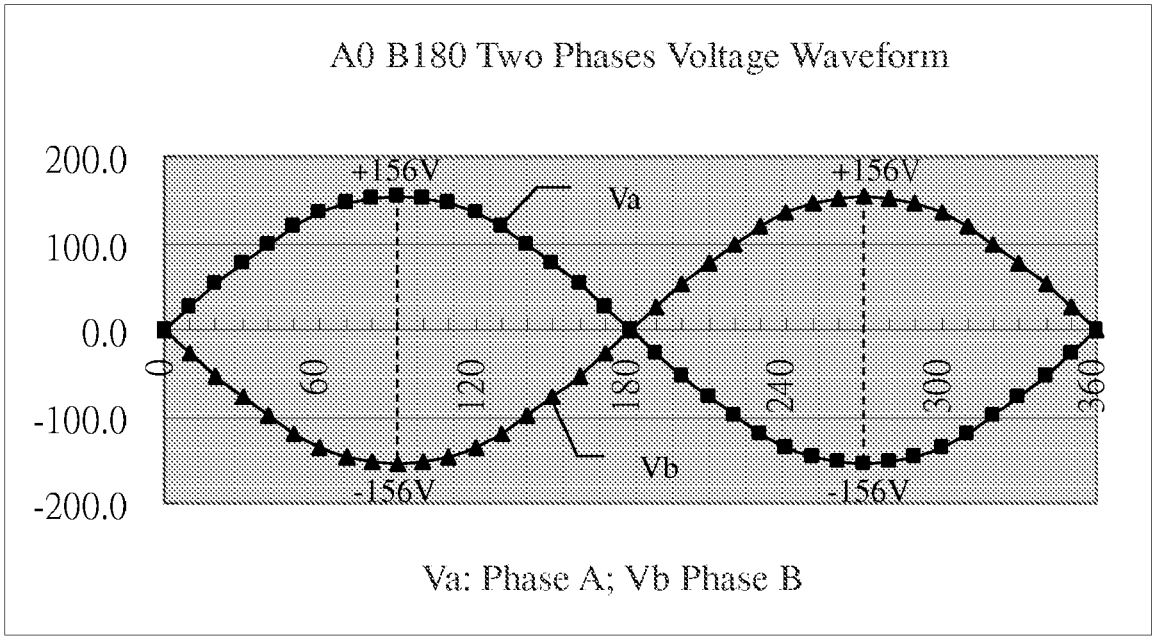
FIGS. 4A to 4D show a third embodiment of an AC_LED driven by two voltage sources with a phase difference of 180 degree.

Referring to FIG. 4A, which shows a voltage waveform with a phase lag of 180 degree. The abscissa shows a voltage phase with a scale of 0~360 degree. The ordinate shows voltage with a scale of −200V~+200V. Curve Va shows the voltage waveform at node Na. Curve Vb shows the voltage waveform at node Nb. Curve Vb has a 180 degree phase lag than curve Va. Curve Va has a positive voltage peak of +156V at phase 90 degree and a negative voltage peak of −156V at phase 270 degree. Curve Vb has a positive voltage peak of +156V at phase 270 degree and a negative voltage peak of −156V at phase 90 degree.

Figure 4B:
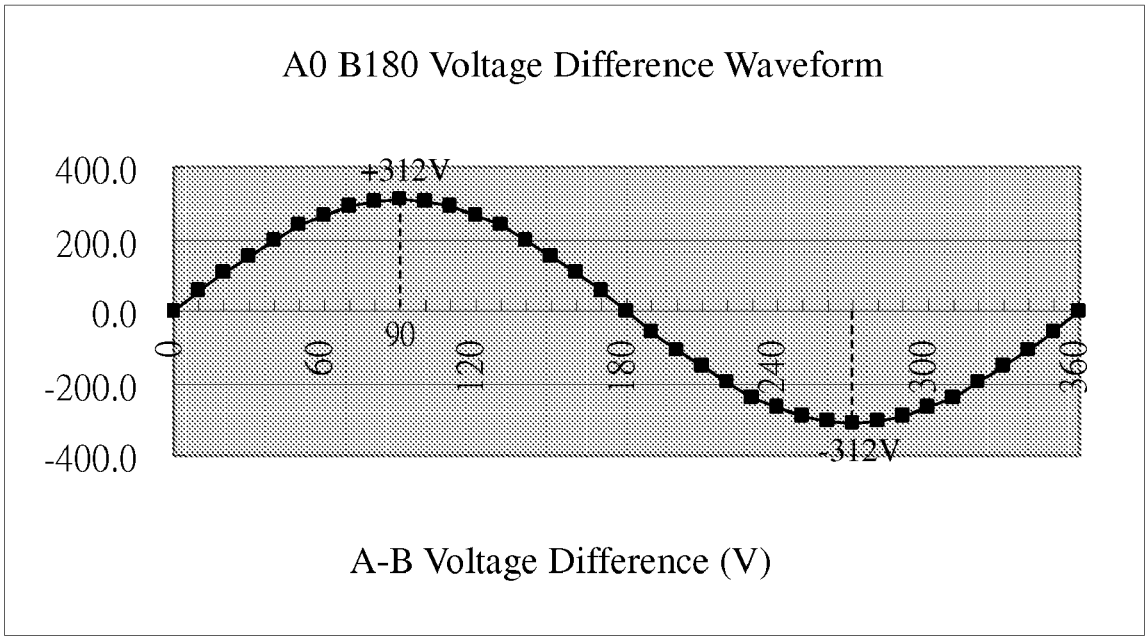

Referring to FIG. 4B, which shows a voltage difference waveform between node Na and node Nb. The abscissa shows voltage phase with a scale of 0~360 degree. The ordinate shows a voltage difference with a scale of −400V~+400V, indicating a positive voltage difference peak of +312V at phase 90 degree, a negative voltage difference peak of −312V at phase 270 degree, and a voltage difference of 0V at phase 0 degree, 180 degree, and 360 degree.

Figure 4C:
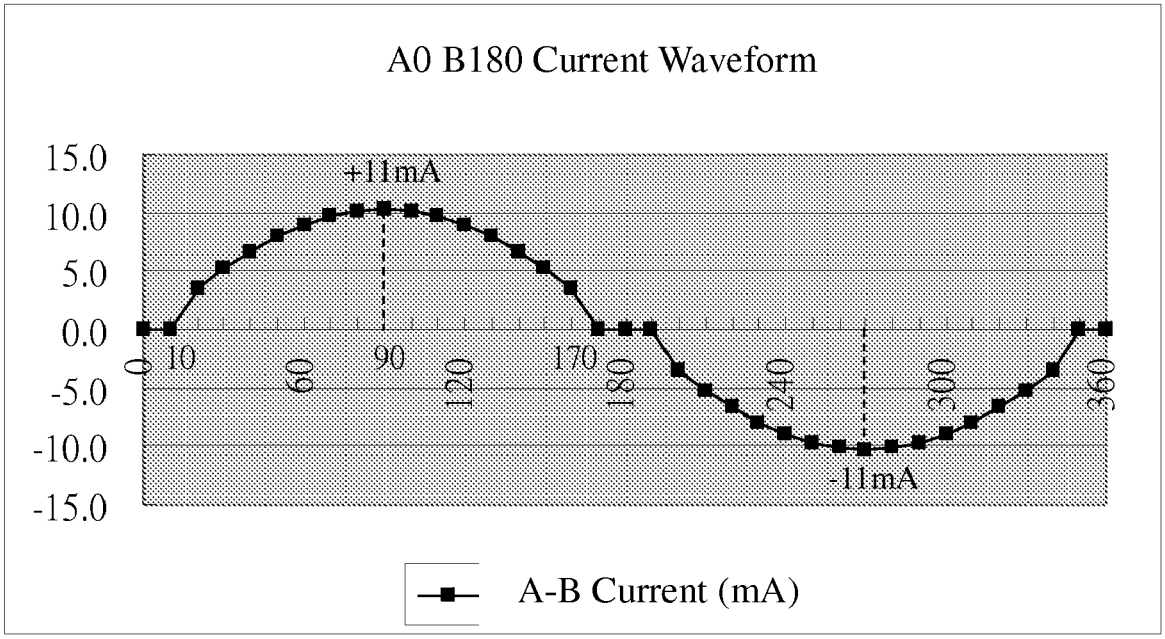

Referring to FIG. 4C, which shows a current waveform. The abscissa shows voltage phase with a scale of 0~360 degree. The ordinate shows current with a scale of −15.0 mA~+15.0 mA. FIG. 4C shows that the positive DC_LED turns on to shine at phase 10~170 degree, and that the negative DC_LED turns on to shine at phase 190~350 degree. There is a positive current peak of +11 mA at phase 90 degree, and a negative current peak of −11 mA at phase 270 degree. Neither the positive DC_LED nor the negative DC_LED illuminates at phase 0~10 degree, 170~190 degree, and 350~360 degree; in other words, both the positive DC_LED and the negative DC_LED turns off during these periods.

Figure 4D:
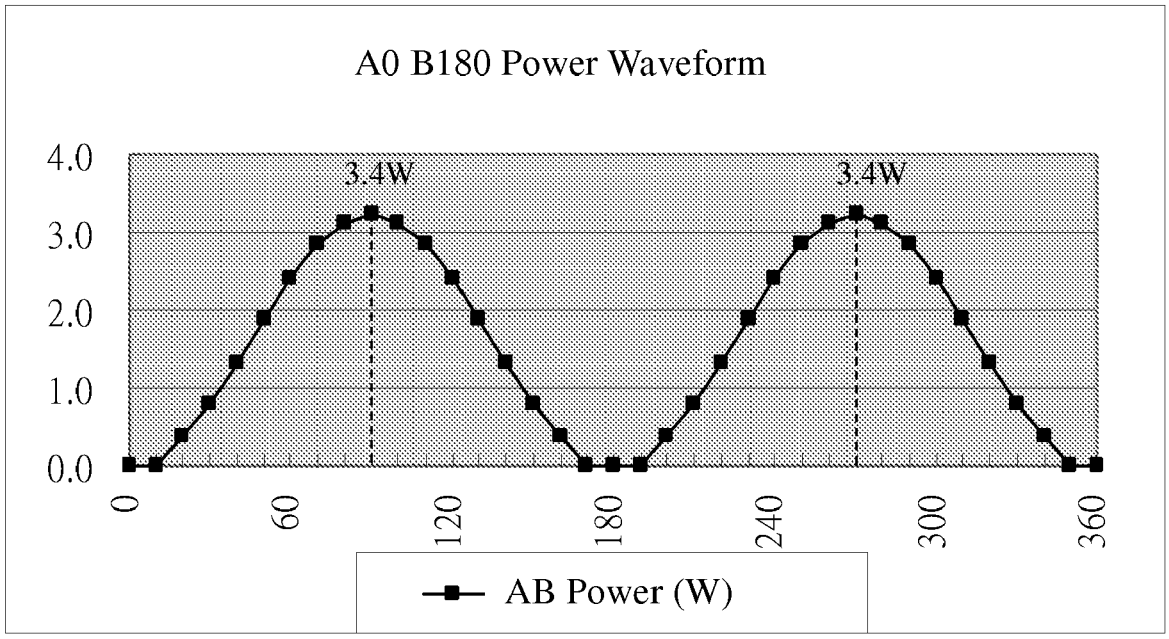

Referring to FIG. 4D, which shows a power waveform. The abscissa shows a voltage phase with a scale of 0~360 degree. The ordinate shows power with a scale of 0.0 W~4.0 W, indicating a power peak of 3.4 W at phase 90 degree and 270 degree for the positive DC_LED and negative DC_LED respectively. The power is 0 W at phase 170~190 degree and 350~360 degree.

Figure 5:
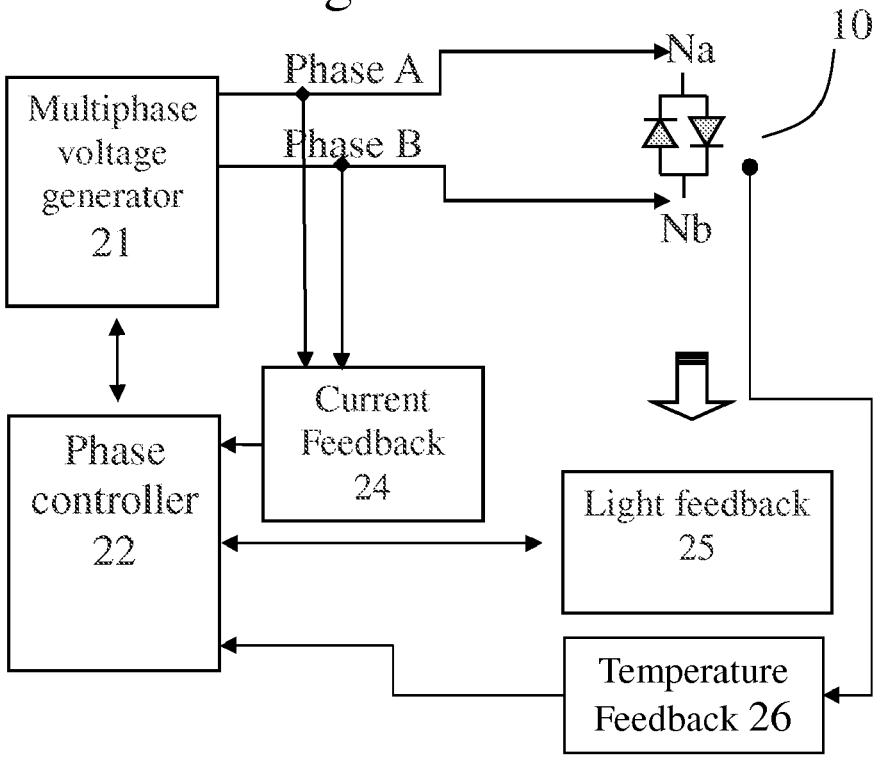
FIG. 5 shows a fourth embodiment with a feedback circuit included.

FIG. 5 shows the fourth embodiment of the present invention, wherein feedback circuits are included.

As regards the system as shown in FIG. 2A, a current feedback circuit 24 can be alternatively incorporated into the system. A first terminal of the current feedback circuit 24 couples to phase A and phase B, a second terminal couples to phase controller 22. The current feedback circuit 24 detects the current between the multiphase voltage sources generator 21 and node Na or node Nb, and provides feedback on the phase fluctuation limits of the output voltage automatically or manually. A light feedback circuit 25 can be alternatively installed to provide feedback on the average light intensity or individual color intensity of the AC_LED 10. A first terminal of the light feedback circuit 25 senses the light irradiation of the AC_LED 10 and a second terminal of the light feedback circuit 25 couples to the phase controller 22. The light intensity or the individual color intensity can be adjusted through adjusting the phase difference. A temperature feedback circuit 26 can be alternatively installed to sense the temperature of the AC_LED 10 or a designated point, thus providing feedback on the phase controller 22 to trigger an overheat protection mechanism (not shown) automatically or manually.

Figure 6:
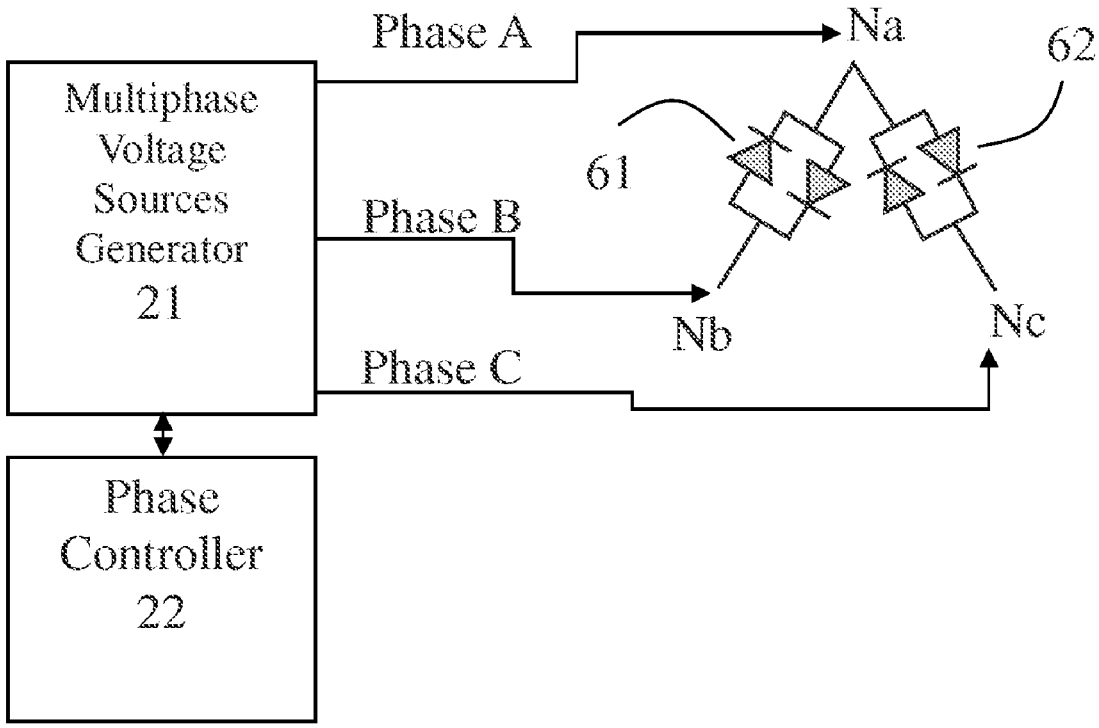
FIG. 6 shows a fifth embodiment, with three-phase voltage source controlling.

FIG. 6. shows an AC_LED driven by a three-phase voltage source of the fifth embodiment of the present invention. A first AC_LED 61 has a first terminal coupling to node Na and a second terminal coupling to node Nb. A second AC_LED 62 has a first terminal coupling to node Na and a second terminal coupling to node Nc. A multiphase voltage sources generator 21 supplies three voltage sources with different phases, phase A, B, and C each to node Na, node Nb, and node Nc respectively. The AC_LED 61 and AC_LED 62 can be same color or different color. Different light timing or color mixing can be achieved by controlling different phase or frequency with respect to each of the three voltage sources.

FIGS. 7A to 7E show an AC_LED driven by a three-phase voltage source of the sixth embodiment of the present invention.

Figure 7A:
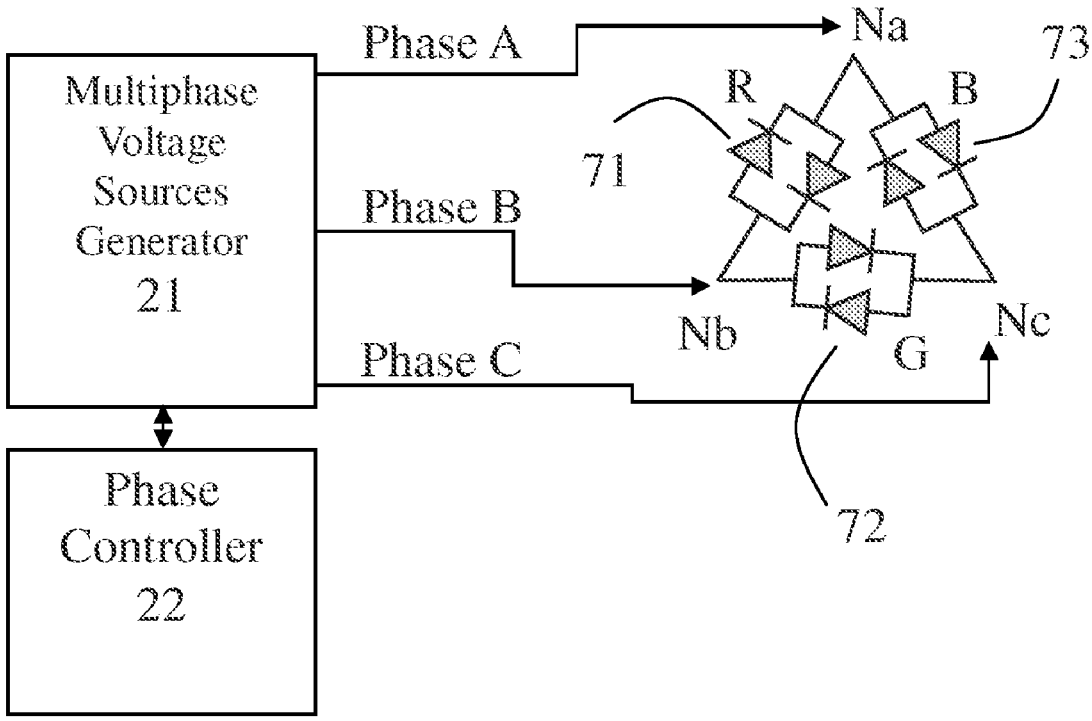
FIGS. 7A to 7E show a sixth embodiment, an AC_LED driven by a three-phase voltage source with a phase difference of 40 degree.

Referring to FIG. 7A, which shows a three-phase voltage controlling system. A first AC_LED 71 has a first terminal coupling to node Na and a second terminal coupling to node Nb. A second AC_LED 72 has a first terminal coupling to node Nb and a second terminal coupling to node Nc. A third AC_LED 73 has a first terminal coupling to node Na and a second terminal coupling to node Nc. A multiphase voltage sources generator 21 supplies three voltage sources with different phases, phase A, B, and C each to node Na, node Nb, and node Nc respectively. The three AC_LEDs can have the same color or different colors. Different light timing or color mixing can be achieved by controlling different phase or frequency of each of the three voltage sources. For a full color shining, the AC_LED 71, AC_LED 72, AC_LED 73 can be red (R), green (G), and blue (B) respectively.

Figure 7B:
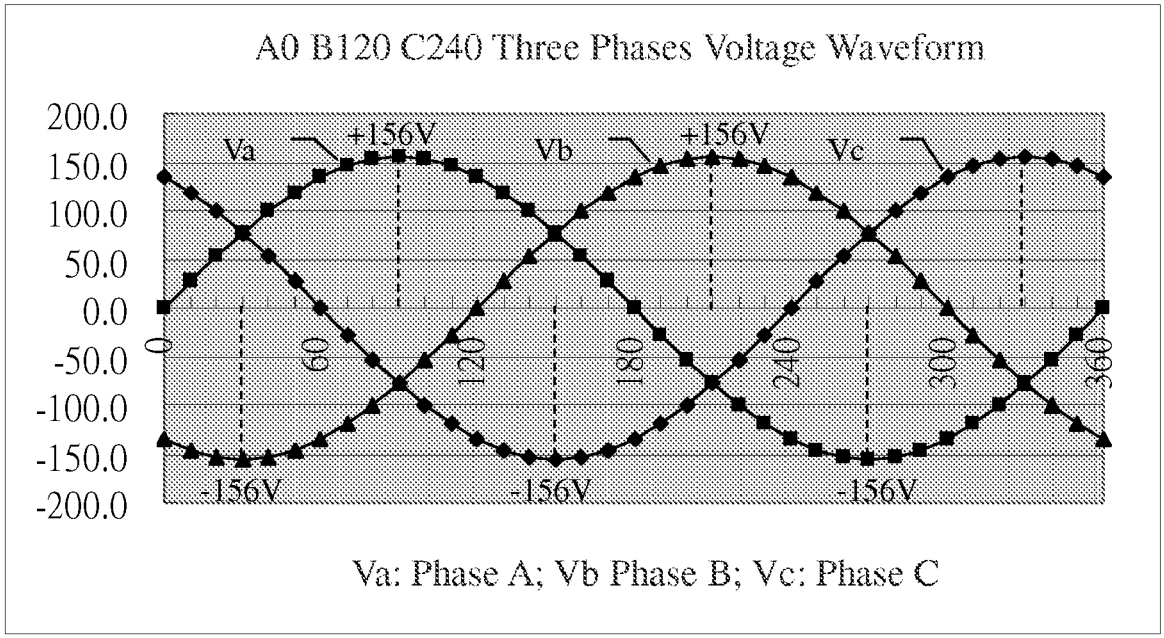

Referring to FIG. 7B, which shows a voltage waveform with a three-phase voltage source. The voltage waveform with a three-phase voltage source as shown in FIG. 7B indicates a phase difference of 120 degree between the first phase Va and the second phase Vb, a phase difference of 120 degree between the second phase Vb and the third phase Vc, and a phase difference of 240 degree between the first phase Va and the third phase Vc. The abscissa shows a voltage phase with a scale of 0~360 degree. The ordinate shows voltage with a scale of −200V~+200V. Curve Va shows the voltage waveform at node Na. Curve Vb shows the voltage waveform at node Nb. Curve Vc shows the voltage waveform at node Nc. Curve Va has a positive voltage peak of +156V at phase 90 degree and a negative voltage peak of −156V at phase 270 degree. Curve Vb has a negative voltage peak of −156V at phase 30 degree and a positive voltage peak of +156V at phase 210 degree. Curve Vc has a negative voltage peak of −156V at phase 150 degree and a positive voltage peak of +156V at phase 330 degree.

Figure 7C:
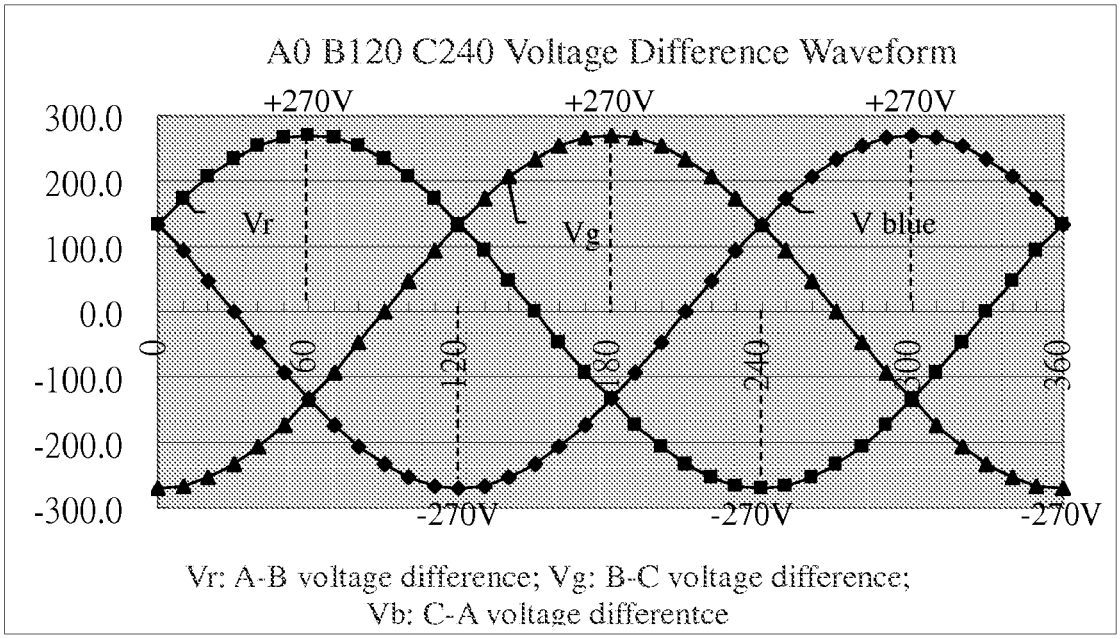

Referring to FIG. 7C, which shows a voltage difference waveform between node Na and node Nb, between node Nb and node Nc, and between node Nc and node Na. The abscissa shows a voltage phase with a scale of 0~360 degree. The ordinate shows a voltage difference with a scale of −300V~+300V. Curve Vr shows the voltage difference between the two terminals of red AC_LED 71, i.e. between node Na and node Nb. Curve Vg shows the voltage difference between the two terminals of green AC_LED 72, i.e. between node Nb and node Nc. Curve Vb1 shows the voltage difference between the two terminals of blue AC_LED 73, i.e. between node Nc and node Na. Curve Vr has a positive voltage difference of +270V at phase 60 degree and a negative voltage difference of −270V at phase 240 degree. Curve Vg has a negative voltage difference of −270V at phase 0 degree, a positive voltage difference of +270V at phase 180 degree, and a negative voltage difference of −270V at phase 360 degree. Curve Vb1 has a negative voltage difference of −270V at phase 120 degree and a positive voltage difference of +270V at phase 300 degree.

Figure 7D:
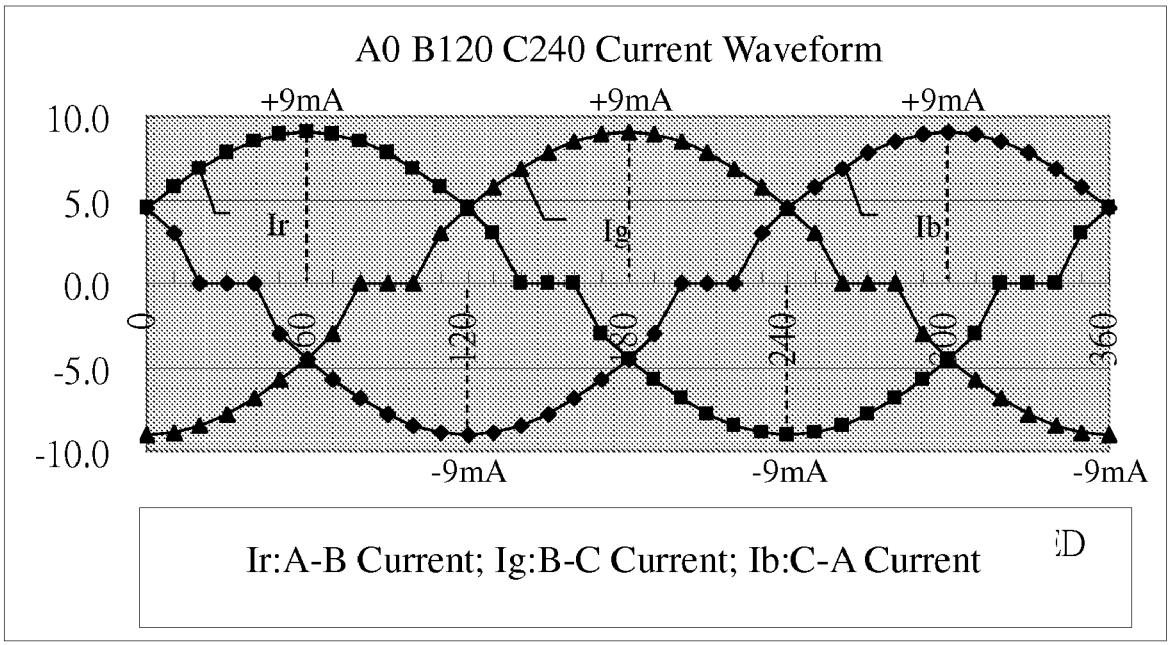

Referring to FIG. 7D, which shows a current waveform. The abscissa shows a voltage phase with a scale of 0~360 degree. The ordinate shows current with a scale of −10.0 mA~+10.0 mA. Curve Ir shows the current of red AC_LED 71, i.e. between node Na and node Nb. Curve Ig shows the current of green AC_LED 72, i.e. between node Nb and node Nc. Curve Ib shows the current of blue AC_LED 73, i.e. between node Nc and node Na. Curve Ir has a positive current peak of +9 mA at phase 60 degree, a current of 0 mA at phase 140~160 degree, a negative current peak of −9 mA at phase 240 degree, and a current of 0 mA at phase 320~340 degree. Curve Ig has a negative current peak of −9 mA at phase 0 degree, a current of 0 mA at phase 80~100 degree, a positive current peak of +9 mA at phase 180 degree, a current of 0 mA at phase 260~280 degree, and a negative current peak of −9 mA at phase 360 degree. Curve Ib has a current of 0 mA at phase 20~40 degree, a negative current peak of −9 mA at phase 120 degree, a current of 0 mA at phase 200~220 degree, and a positive current peak of +9 mA at phase 200 degree.

Figure 7E:
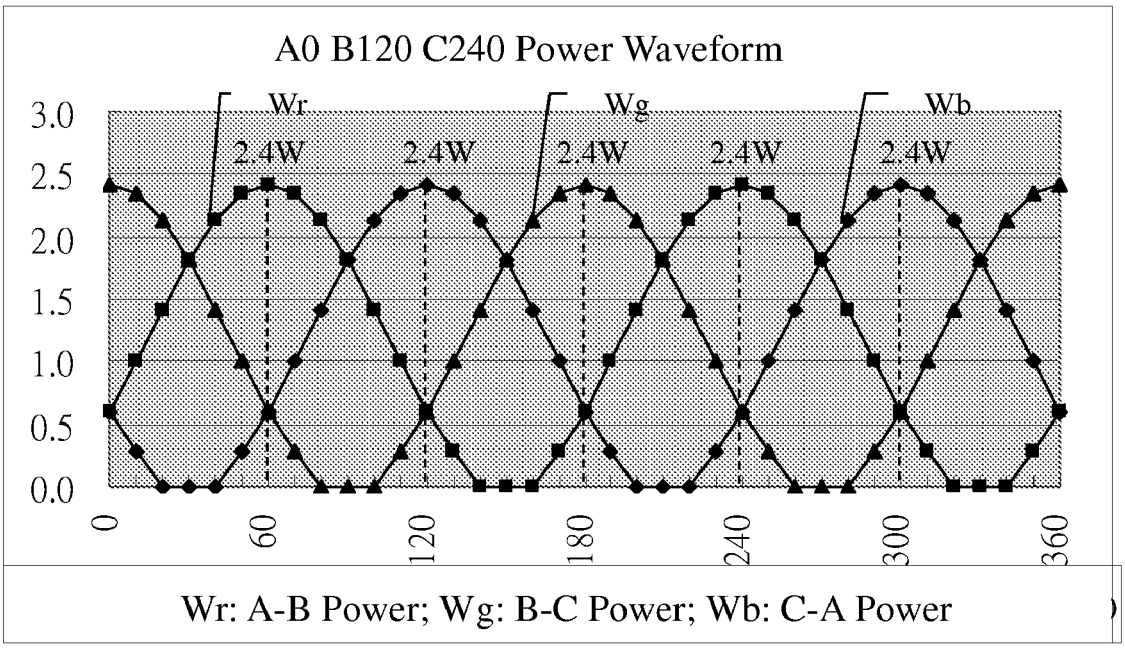

Referring to FIG. 7E, which shows a power waveform. The abscissa shows a voltage phase with a scale of 0~360 degree. The ordinate shows power with a scale of 0.0 W~3.0 W. Curve Wr shows the power of red AC_LED 71, i.e. between node Na and node Nb. Curve Wg shows the power of green AC_LED 72, i.e. between node Nb and node Nc. Curve Wb shows the power of blue AC_LED 73, i.e. between node Nc and node Na. Curve Wr has a power peak of 2.4 W at phase 60 degree. Curve Wr has a power of 0 W at phase 140~160 degree. Curve Wr has a power peak of 2.4 W at phase 240 degree. Curve Wr has a power of 0 W at phase 320~340 degree. Curve Wg has a power peak of 2.4 W at phase 0 degree. Curve Wg has a power of 0 W at phase 80~100 degree. Curve Wg has a power peak of 2.4 W at phase 180 degree. Curve Wg has a power of 0 W at phase 260~280 degree. Curve Wg has a power peak of 2.4 W at phase 360 degree. Curve Wb has a power of 0 W at phase 20~40 degree. Curve Wb has a power peak of 2.4 W at phase 120 degree. Curve Wb has a power of 0 W at phase 200~220 degree. Curve Wb has a power peak of 2.4 W at phase 300 degree.

FIGS. 8A to 8D show an AC_LED driven by a three-phase voltage source with a phase difference of 90 degree of the seventh embodiment of the present invention.

Figure 8A:
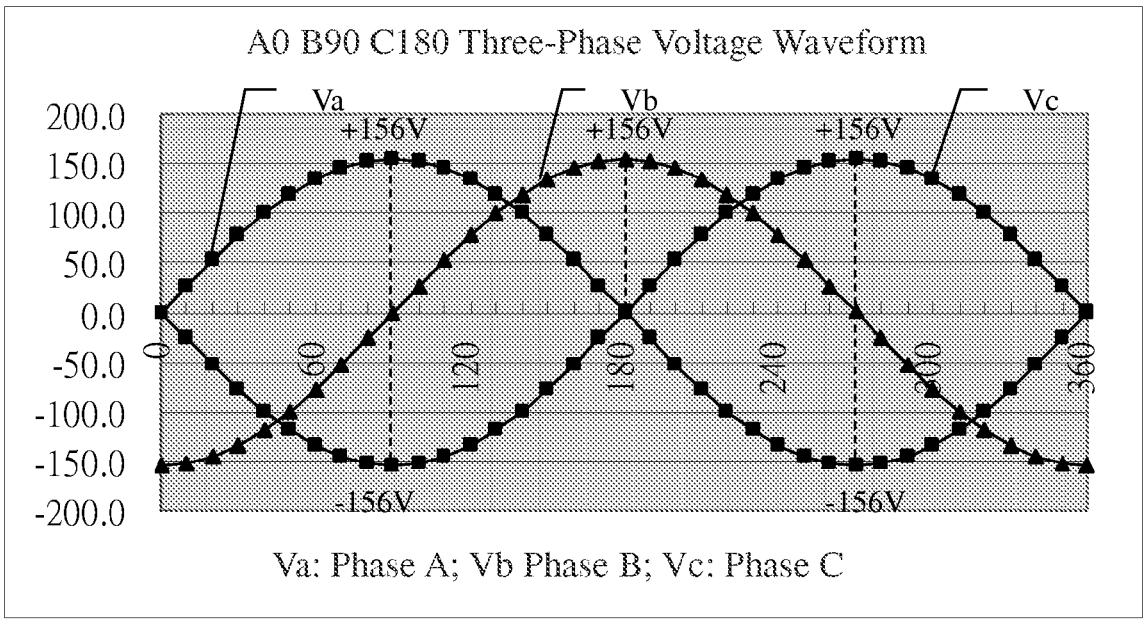
FIGS. 8A to 8D show a seventh embodiment, an AC_LED driven by a three-phase voltage source.

Referring to FIG. 8A, which shows a voltage waveform for a three-phase voltage source. The abscissa shows a voltage phase with a scale of 0~360 degree. The ordinate shows voltage with a scale of −200V~+200V, indicating a phase difference of 90 degree between curve Va and curve Vb, a phase difference of 90 degree between curve Vb and curve Vc, and a phase difference of 180 degree between curve Va and curve Vc. Curve Va has a positive voltage peak of +156V at phase 0 degree. Curve Va has a negative voltage peak of −156V at phase 270 degree. Curve Vb has a negative voltage peak of −156V at phase 0 degree. Curve Vb has a positive voltage peak of +156V at phase 180 degree. Curve Vb has a negative voltage peak of −156V at phase 360 degree. Curve Vc has a negative voltage peak of −156V at phase 90 degree. Curve Vc has a positive voltage peak of +156V at phase 270 degree.

Figure 8B:
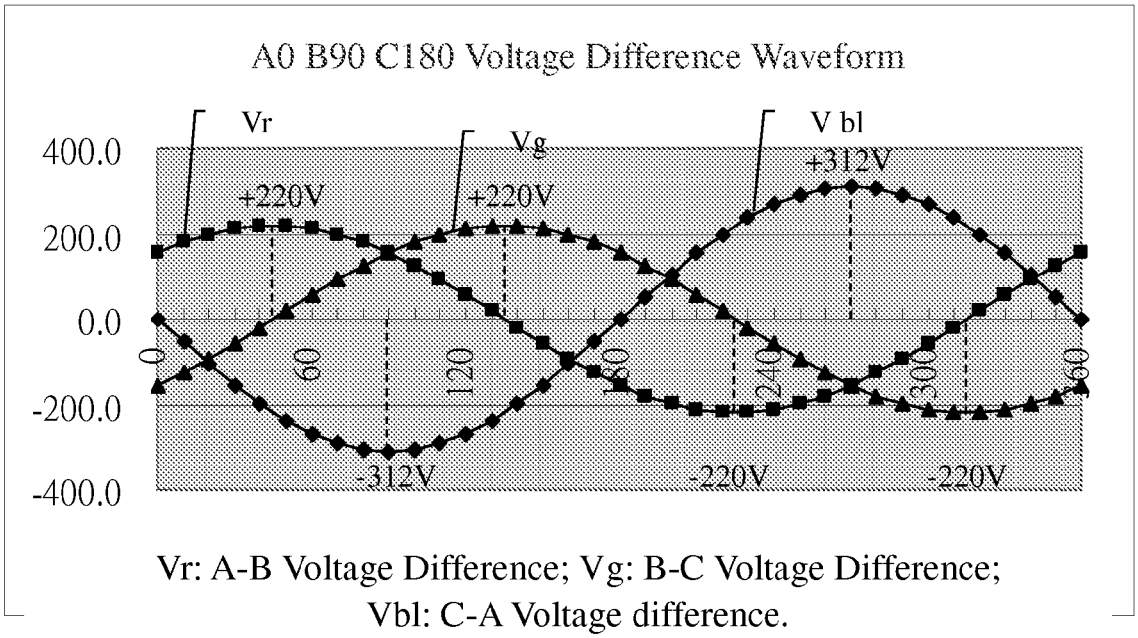

Referring to FIG. 8B, which shows a voltage difference waveform. Curve Vr shows a voltage difference between the two terminals of red AC_LED 71, i.e. between node Na and node Nb. Curve Vg shows a voltage difference between the two terminals of green AC_LED 72, i.e. between node Nb and node Nc. Curve Vb1 shows a voltage difference between the two terminals of blue AC_LED 73, i.e. between node Nc and node Na. Curve Vr has a positive voltage difference of +220V at phase 45 degree. Curve Vr has a negative voltage difference of −220V at phase 225 degree. Curve Vg has a positive voltage difference of +220V at phase 135 degree. Curve Vg has a negative voltage difference of −220V at phase 315 degree. Curve Vb1 has a negative voltage difference of −312V at phase 90 degree. Curve Vb1 has a positive voltage difference of +312V at phase 270 degree.

Figure 8C:
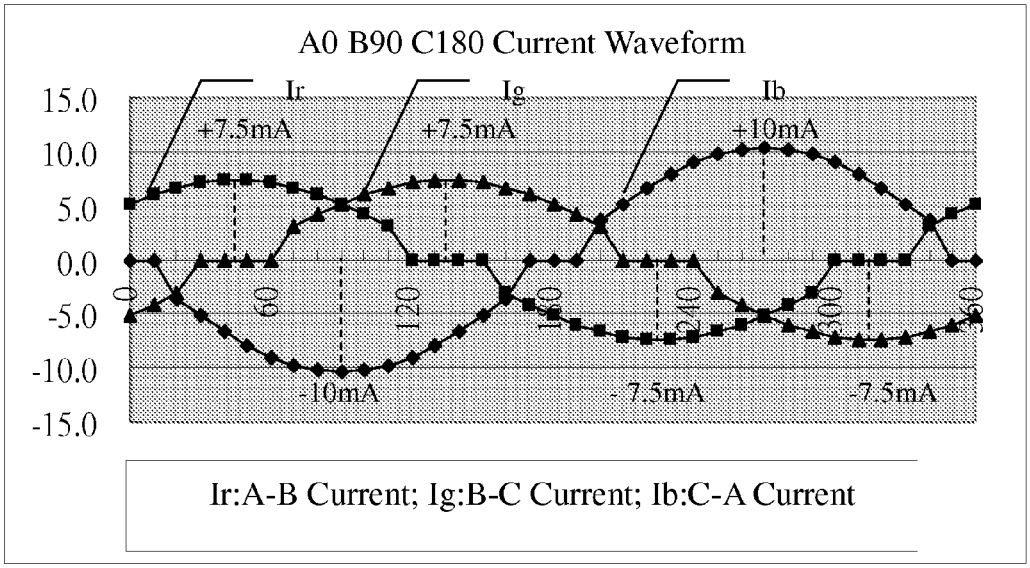

Referring to FIG. 8C, which shows a current waveform. The abscissa shows a voltage phase with a scale of 0~360 degree. The ordinate shows current with a scale of −15.0 mA~+15.0 mA. Curve Ir shows the current of red AC_LED 71, i.e. between node Na and node Nb. Curve Ig shows the current of green AC_LED 72, i.e. between node Nb and node Nc. Curve Ib shows the current of blue AC_LED 73, i.e. between node Nc and node Na. Curve Ir has a positive current peak of +7.5 mA at phase 45 degree. Curve Ir has a current of 0 mA at phase 120~150 degree. Curve Ir has a negative current peak of −7.5 mA at phase 225 degree. Curve Ir has a current of 0 mA at phase 300~330 degree. Curve Ig has a current of 0 mA at phase 30~60 degree. Curve Ig has a positive current peak of +7.5 mA at phase 135 degree. Curve Ig has a current of 0 mA at phase 210~240 degree. Curve Ig has a negative current peak of −7.5 mA at phase 315 degree. Curve Ib has a current of 0 mA at phase 0~10 degree. Curve Ib has a negative current peak of −10.0 mA at phase 90 degree. Curve Ib has a current of 0 mA at phase 170~190 degree. Curve Ib has a positive current peak of +10.0 mA at phase 270 degree. Curve Ib has a current of 0 mA at phase 350~360 degree.

Figure 8D:
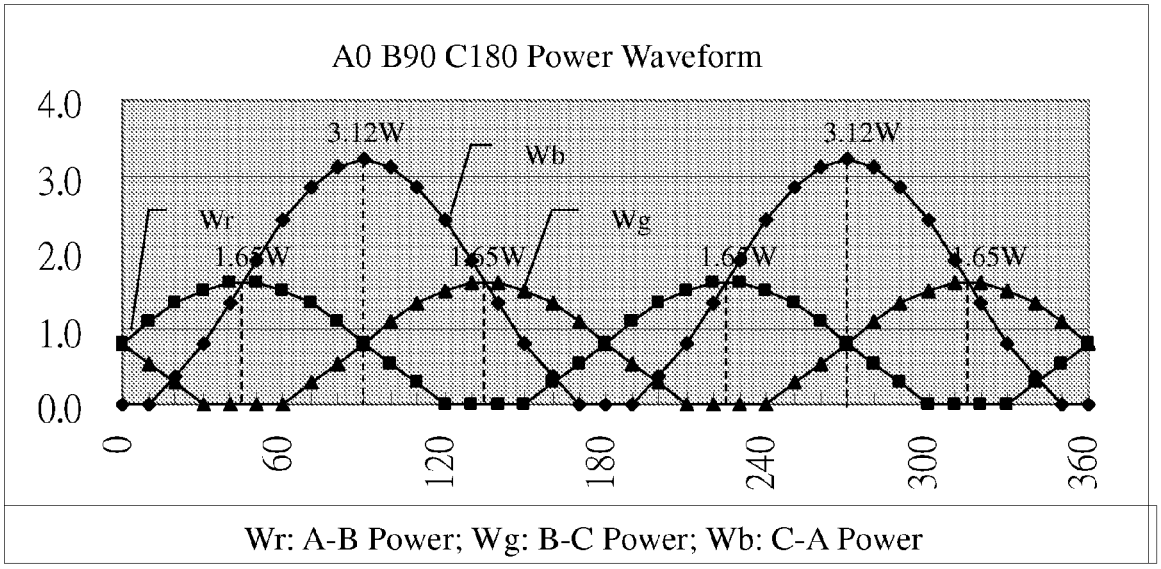

Referring to FIG. 8D, which shows a power waveform. The abscissa shows a voltage phase with a scale of 0~360 degree. The ordinate shows power with a scale of 0.0 W~4.0 W. Curve Wr shows the power of red AC_LED 71, i.e. between node Na and node Nb. Curve Wg shows the power of green AC_LED 72, i.e. between node Nb and node Nc. Curve Wb shows the power of blue AC_LED 73, i.e. between node Nc and node Na. Curve Wr has a power peak of 1.65 W at phase 45 degree. Curve Wr has a power of 0 W at phase 120~150 degree. Curve Wr has a power peak of 1.65 W at phase 225 degree. Curve Wr has a power of 0 W at phase 300~330 degree. Curve Wg has a power of 0 W at phase 30~60 degree. Curve Wg has a power peak of 1.65 W at phase 135 degree. Curve Wg has a power of 0 W at phase 210~240 degree. Curve Wg has a power peak of 1.65 W at phase 315 degree. Curve Wb has a power of 0 W at phase 0~10 degree. Curve Wb has a power peak of 3.12 W at phase 90 degree. Curve Wg has a power of 0 W at phase 170~190 degree. Curve Wg has a power peak of 3.12 W at phase 270 degree. Curve Wb has a power of 0 W at phase 350~360 degree.

FIGS. 9A to 9E show an AC_LED driven by a four-phase voltage source of the eighth embodiment of the present invention.

Figure 9A:
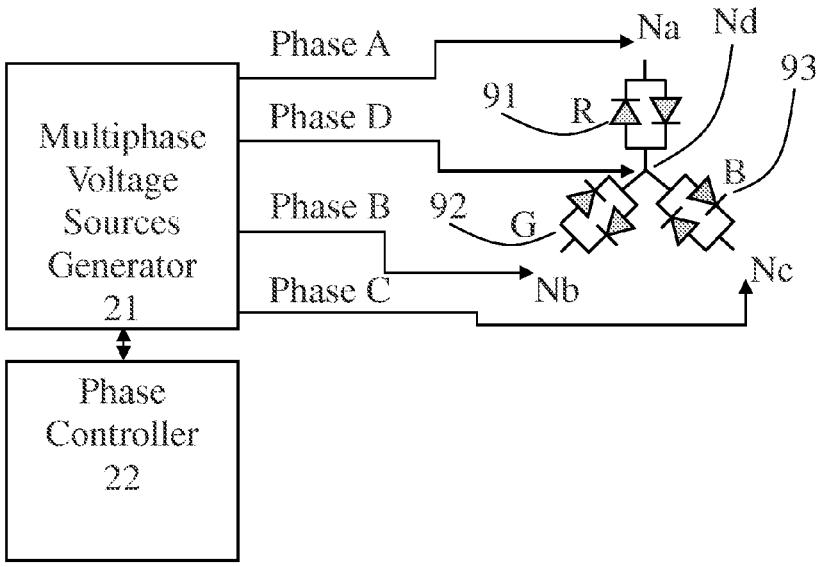
FIGS. 9A to 9E show an eighth embodiment, an AC_LED driven by a four-phase voltage source.

Referring to FIG. 9A, which shows an AC_LED driven by a four-phase voltage source. A first AC_LED 91 has a first terminal coupling to node Na and a second terminal coupling to node Nd. A second AC_LED 92 has a first terminal coupling to node Nd and a second terminal coupling to node Nb. A third AC_LED 73 has a first terminal coupling to node Nd and a second terminal coupling to node Nc. A multiphase voltage sources generator 21 supplies four voltage sources with different phases, namely phases A, B, C, and D, to node Na, node Nb, node Nc, and node Nd respectively. The three AC_LEDs can have the same color or different colors. Different light timing or color mixing can be achieved by controlling different phase or frequency of each of the four voltage sources. For a full color shining, the AC_LED 91, AC_LED 92, AC_LED 93 can be red (R), green (G), and blue (B) respectively.

Figure 9B:
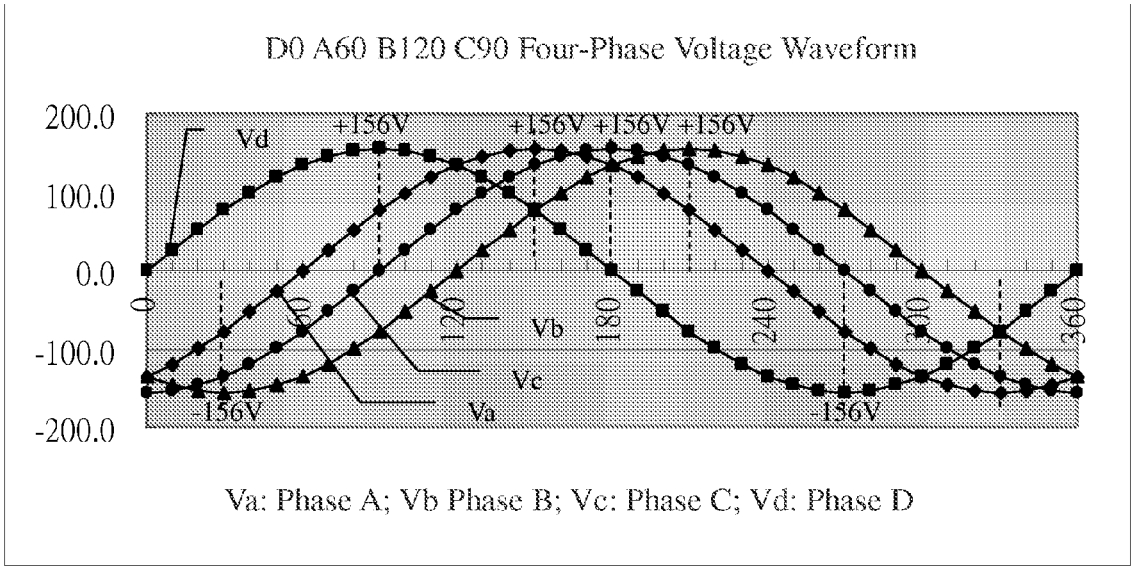

Referring to FIG. 9B, which shows a voltage waveform. Curve Va shows the voltage waveform of node Na. Curve Vb shows the voltage waveform of node Nb. Curve Vc shows the voltage waveform of node Nc. Curve Vd shows the voltage waveform of node Nd. The voltage waveform shown in FIG. 9B indicates a phase difference of 60 degree between the first phase Va and the second phase Vb, a phase of 30 degree between the second phase Vb and the third phase Vc, a phase difference of 90 degree between the third phase Vc and the fourth phase Vd, and a phase difference of 60 degree between the fourth phase Vd and the first phase Va. Curve Va has a positive voltage peak of +156V at phase 150 degree and a negative voltage peak of −156V at phase 330 degree. Curve Vb has a negative voltage peak of −156V at phase 30 degree and a positive voltage peak of +156V at phase 210 degree. Curve Vc has a negative voltage peak of −156V at phase 0 degree, a positive voltage peak of +156V at phase 180 degree, and a negative voltage peak of −156V at phase 360 degree. Curve Vd has a positive voltage peak of +156V at phase 90 degree and a negative voltage peak of −156V at phase 270 degree.

Figure 9C:
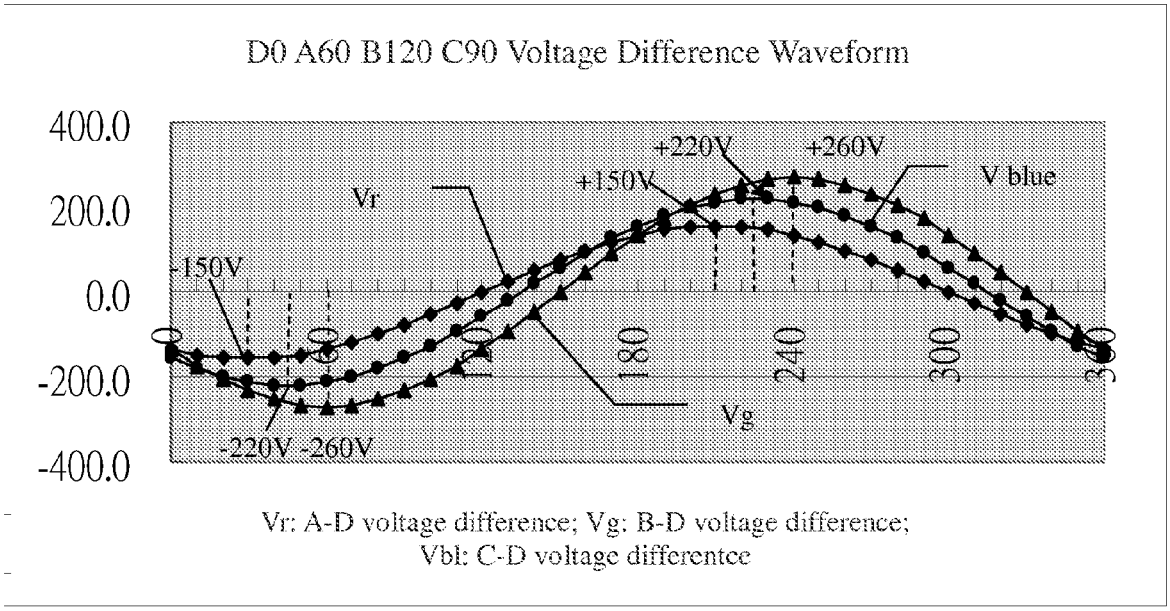

Referring to FIG. 9C, which shows a voltage difference waveform. The abscissa shows a voltage phase with a scale of 0~360 degree. The ordinate shows a voltage difference with a scale of −400V~+400V. Curve Vr shows the voltage difference between the two terminals of red AC_LED 91, i.e. between node Na and node Nd. Curve Vg shows the voltage difference between the two terminals of green AC_LED 92, i.e. between node Nb and node Nd. Curve Vb shows the voltage difference between the two terminals of blue AC_LED 93, i.e. between node Nc and node Nd. Curve Vr has a negative voltage difference peak of −150V at phase 30 degree and a positive voltage difference peak of +150V at phase 210 degree. Curve Vg has a negative voltage difference peak of −260V at phase 60 degree and a positive voltage difference peak of +260V at phase 240 degree. Curve Vb1 has a negative voltage difference peak of −220V at phase 45 degree and a positive voltage difference peak of +220V at phase 225 degree.

Figure 9D:
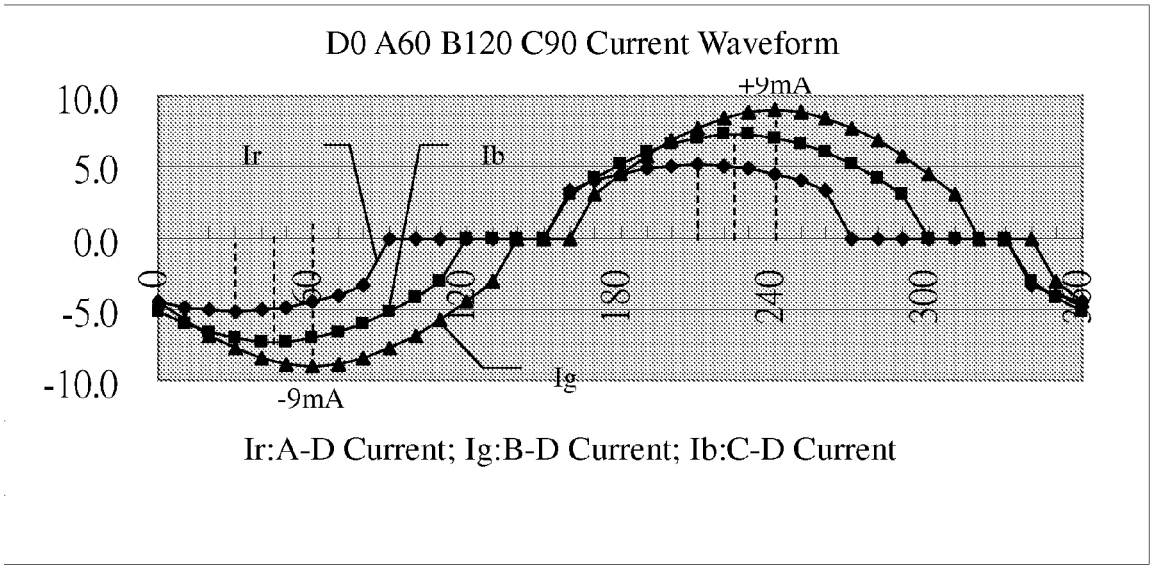

Referring to FIG. 9D, which shows a current waveform. The abscissa shows a voltage phase with a scale of 0~360 degree. The ordinate shows current with a scale of −10.0 mA~+10.0 mA. Curve Ir shows the current of red AC_LED 91, i.e. between node Na and node Nd. Curve Ig shows the current of green AC_LED 92, i.e. between node Nb and node Nd. Curve Ib shows the current of blue AC_LED 93, i.e. between node Nc and node Nd. Curve Ir has a negative current peak of −5 mA at phase 30 degree, a current of 0 mA at phase 90~150 degree, a positive current peak of +5 mA at phase 210 degree, and a current of 0 mA at phase 270~330 degree. Curve Ig has a negative current peak of −9 mA at phase 60 degree, a current of 0 mA at phase 140~160 degree, a positive current peak of +9 mA at phase 240 degree, and a current of 0 mA at phase 320~340 degree. Curve Ib has a negative current peak of −7.5 mA at phase 45 degree, a current of 0 mA at phase 120~150 degree, a positive current peak of +7.5 mA at phase 225 degree, and a current of 0 mA at phase 300~330 degree.

Figure 9E:
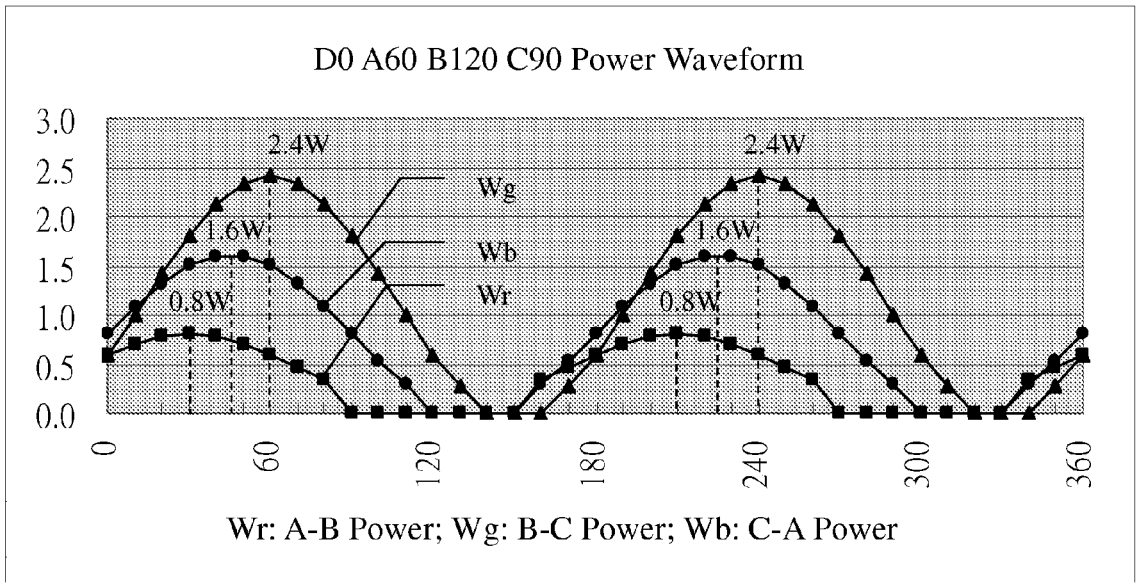

Referring to FIG. 9E, which shows a power waveform. The abscissa shows a voltage phase with a scale of 0~360 degree. The ordinate shows power with a scale of 0.0 W~3.0 W. Curve Wr shows the power of red AC_LED 91, i.e. between node Na and node Nd. Curve Wg shows the power of green AC_LED 92, i.e. between node Nb and node Nd. Curve Wb shows the power of blue AC_LED 93, i.e. between node Nc and node Nd. Curve Wr has a power peak of 0.8 W at phase 30 degree, a power of 0 W at phase 90~150 degree, a power peak of 0.8 W at phase 210 degree, and a power of 0 W at phase 270~330 degree. Curve Wg has a power peak of 2.4 W at phase 60 degree, a power of 0 W at phase 140~160 degree, a power peak of 2.4 W at phase 240 degree, and a power of 0 W at phase 320~330 degree. Curve Wb has a power peak of 1.6 W at phase 45 degree, a power of 0 W at phase 120~150 degree, a power peak of 1.6 W at phase 225 degree, and a power of 0 W at phase 300~330 degree.

As shown in FIGS. 10A to 10D, the ninth embodiment of the present invention discloses changing light timing by changing the frequency of one of the multiphase voltage sources.

Figure 10A:
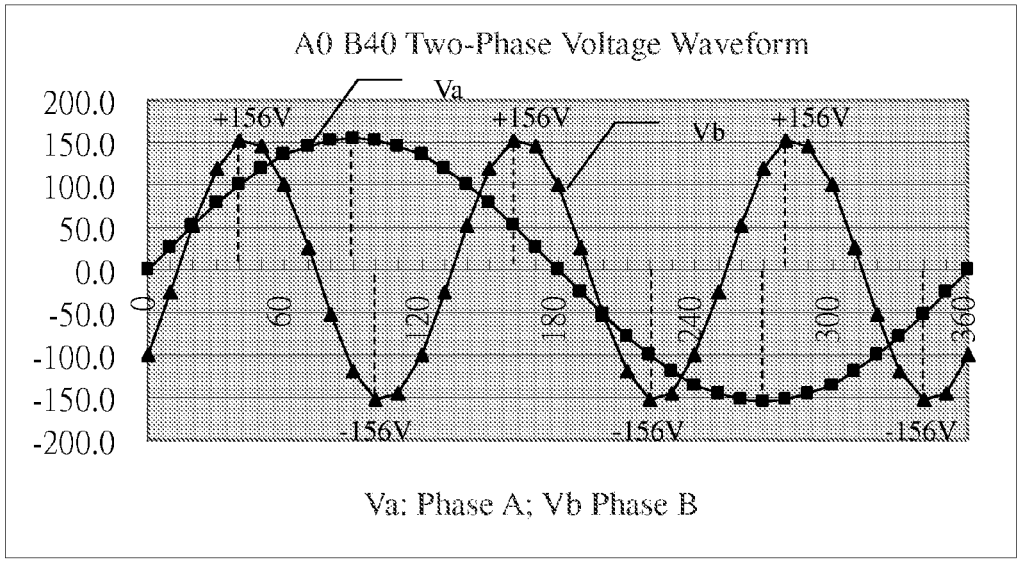
FIGS. 10A to 10D show a ninth embodiment, an AC_LED driven by two voltage sources with different frequency.

Referring to FIG. 10A, which shows a voltage waveform for two-phase voltage source. The abscissa shows a voltage phase with a scale of 0~360 degree. The ordinate shows voltage with a scale of −200V~+200V. Curve Va shows a first phase voltage source coupling to node Na. Curve Vb shows a second phase voltage source coupling to node Nb. The frequency of Curve Vb is three times that of Curve Va. Curve Va has a positive voltage of +156V at phase 90 degree and a negative voltage peak of −156V at phase 270 degree. Curve Vb has a positive voltage of +156V at phase 40 degree, a negative voltage of −156V at phase 100 degree, a positive voltage of +156V at phase 160 degree, a negative voltage of −156V at phase 220 degree, a positive voltage of +156V at phase 280 degree, and a negative voltage of −156V at phase 340 degree.

Figure 10B:
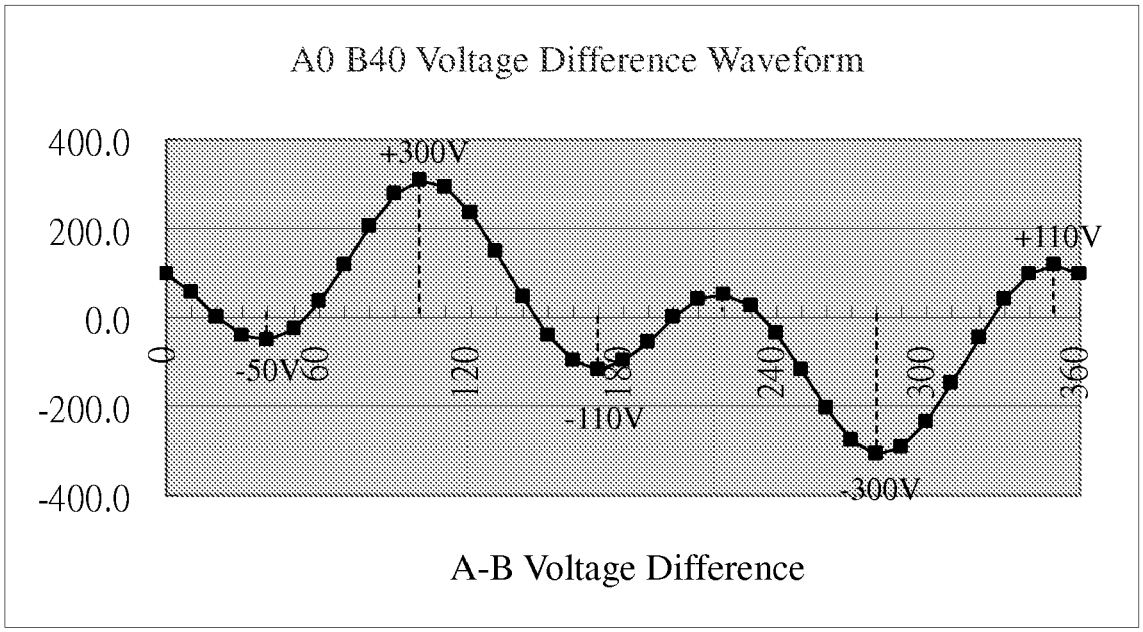

Referring to FIG. 10B, which shows a voltage difference waveform. The abscissa shows a voltage phase with a scale of 0~360 degree. The ordinate shows voltage with a scale of −400V~+400V. The voltage difference waveform shown in FIG. 10B indicates a first negative voltage difference peak of −50V at phase 40 degree, a first positive voltage difference peak of +300V at phase 100 degree, a second negative voltage difference peak of −110V at phase 170 degree, a second positive voltage difference peak of +50V at phase 220 degree, a third negative voltage difference peak of −300V at phase 280 degree, and a third positive voltage difference peak of +110V at phase 350 degree.

Figure 10C:
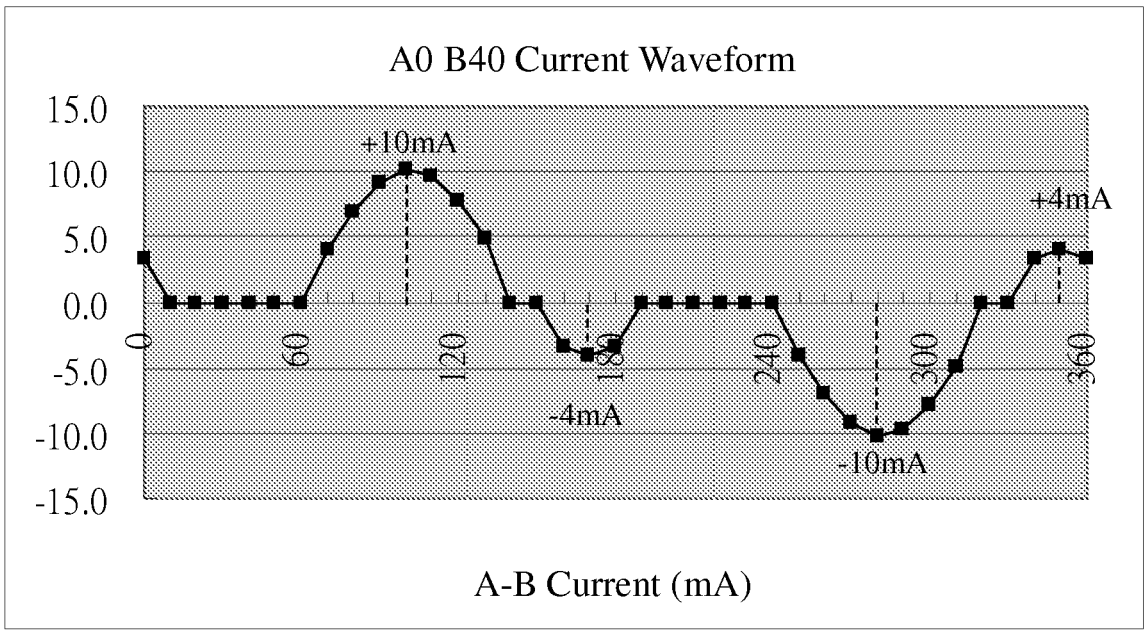

Referring to FIG. 10C, which shows a current waveform. The abscissa shows a voltage phase with a scale of 0~360 degree. The ordinate shows current with a scale of −15.0 mA~+15.0 mA. The current waveform shown in FIG. 10C indicates a current of 0 mA at phase 10~60 degree, a first positive current peak of +10 mA at phase 100 degree, a current of 0 mA at phase 140~150 degree, a first negative current peak of −4 mA at phase 170 degree, a current of 0 mA at phase 190~240 degree, a second negative current peak of −10 mA at phase 280 degree, a current of 0 mA at phase 320~330 degree, and a second positive current peak of +4 mA at phase 350 degree.

Figure 10D:
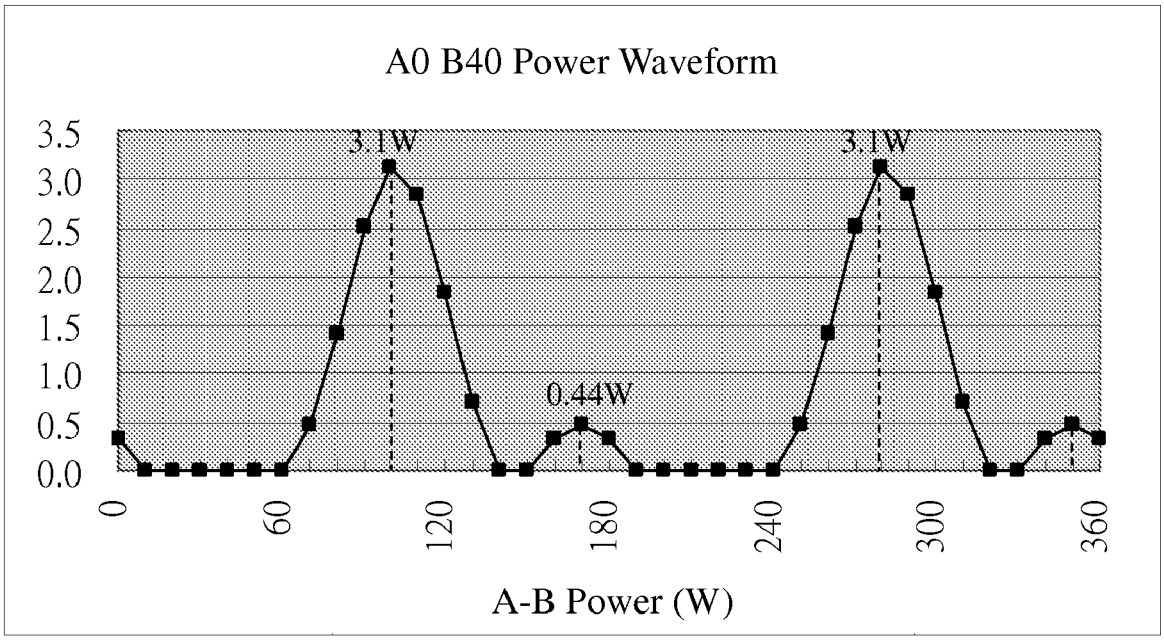

Referring to FIG. 10D, which shows a power waveform. The abscissa shows a voltage phase with a scale of 0~360 degree. The ordinate shows power with a scale of 0.0 W~3.5

W. There is a power of 0 W at phase 10~60 degree. The power waveform shown in FIG. 10D indicates a first power peak of 3.1 W at phase 100 degree, a power of 0 W at phase 140~150 degree, a second power peak of 0.44 W at phase 170 degree, a power of 0 W at phase 190~240 degree, a third power peak of 3.1 W at phase 280 degree, a power of 0 W at phase 320~330 degree, and a fourth power peak of 0.44 W at phase 350 degree.

Figure 11:
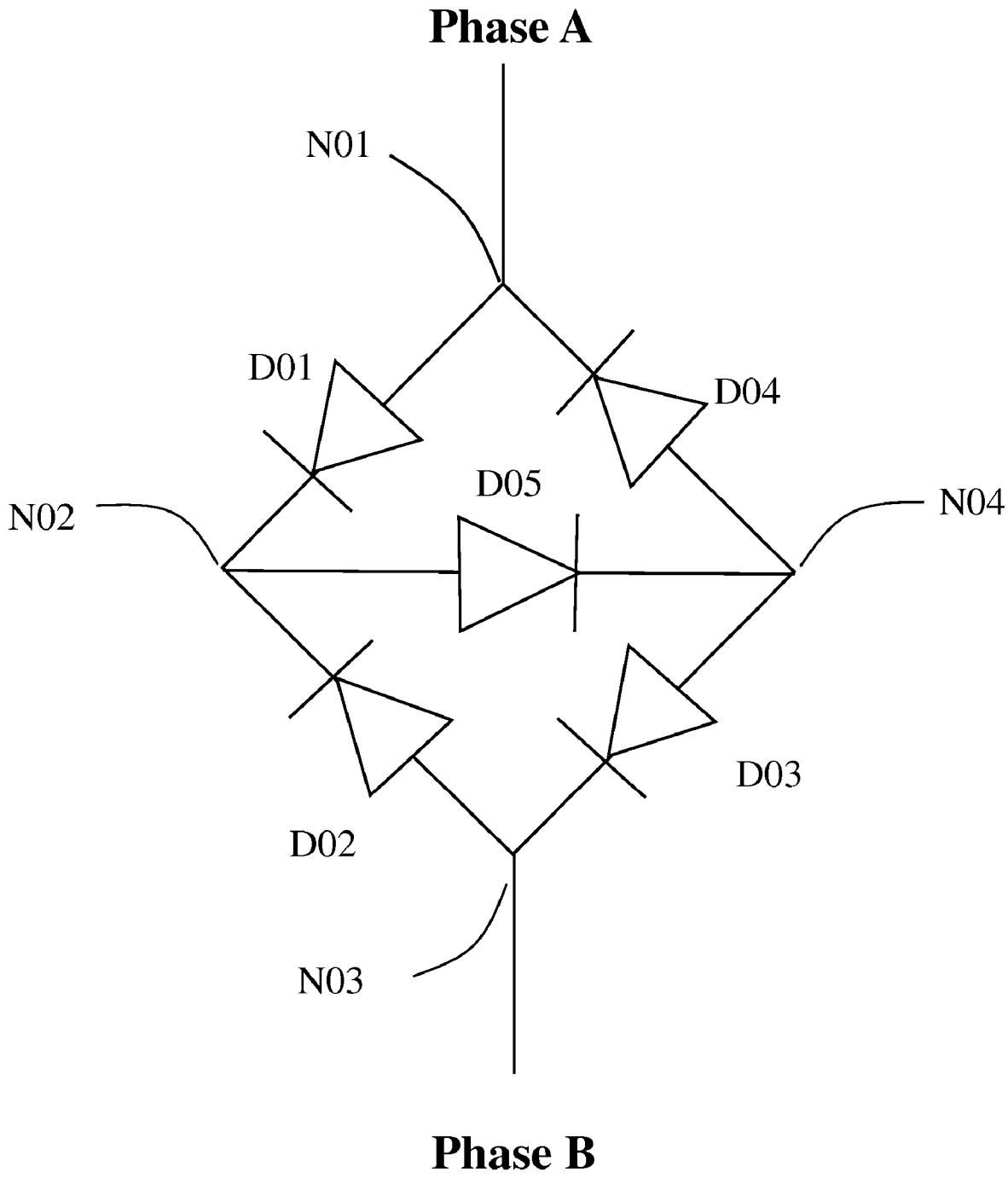
FIG. 11 shows a tenth embodiment, an AC_LED with two terminals.

Referring to FIG. 11, which shows the tenth embodiment of the present invention. The AC_LED 10 used in this invention can also be implemented with a different AC_LED that is a combination of five DC_LEDs. FIG. 11 shows the relationship among the five DC_LEDs that forms an AC_LED. The structure of the AC_LED comprises:

a first node N01, a second node N02, a third node N03, and a fourth node N04 a first diode D01, electrically coupling from said first node N01 in forward direction to said second node N02;

a second diode D02, electrically coupling from said second node N02 in backward direction to said third node N03;

a third diode D03, electrically coupling from said third node N03 in backward direction to said fourth node N04;

a fourth diode D04, electrically coupling from said fourth node N04 in backward direction to said first node N01;

a fifth diode D05, electrically coupling from said second node N02 in forward direction to said fourth node N04; and a node N01 couples to a first voltage source with a first phase, say phase A, and said third node N03 couples to a second voltage source with a second phase, say phase B.

A multiphase voltage sources generator (not shown) supplies a first voltage source having a first phase to node N01, and supplies a second voltage source having a second phase to node N03. The current path from node N01 to node N03 is D01-D05-D03, and the current path from node N03 to node N01 is D02-D05-D04.

Figure 12:
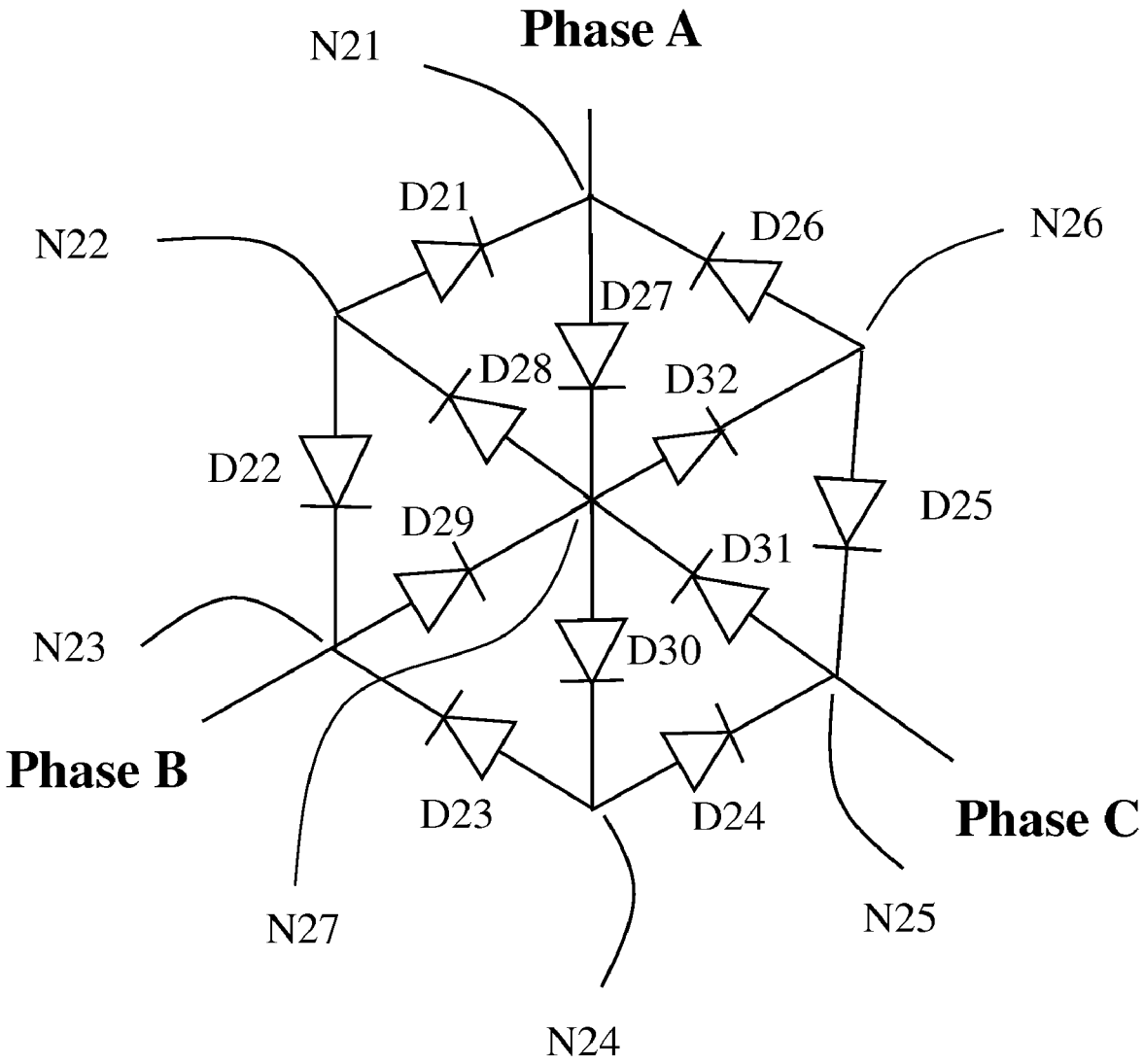
FIG. 12 shows an eleventh embodiment, an AC_LED with three terminals.

FIG. 12 shows the eleventh embodiment of the present invention. The AC_LED with three terminals controlled by three-phase voltage source in this invention can also be implemented with a different AC_LED that is a combination of twelve DC_LEDs. FIG. 12 shows the relationship among the twelve DC_LEDs that forms an AC_LED with three terminals. The structure of the AC_LED comprises:

a first node N21, a second node N22, a third node N23, a fourth node N24, a fifth node N25, a sixth node N26, and a seventh node N27;

a first diode D21, electrically coupling from node N21 in backward direction to node N22;

a second diode D22, electrically coupling from node N22 in forward direction to node N23;

a third diode D23, electrically coupling from node N23 in backward direction to node N24;

a fourth diode D24, electrically coupling from node N24 in forward direction to node N25;

a fifth diode D25, electrically coupling from node N25 in backward direction to node N26;

a sixth diode D26, electrically coupling from node N26 in forward direction to node N21;

a seventh diode D27, electrically coupling from node N27 in backward direction to node N21;

an eighth diode D28, electrically coupling from node N27 in forward direction to node N22;

a ninth diode D29, electrically coupling from node N27 in backward direction to node N23;

a tenth diode D30, electrically coupling from node N27 in forward direction to node N24;

an eleventh diode D23, electrically coupling from node N27 in backward direction to node N25;

a twelfth diode D32, electrically coupling from node N27 in forward direction to node N26; and said node N21 couples to a first voltage source with a first phase, say phase A, and node N23 couples to a second voltage source with a second phase, say phase B, and node N25 couples to a third phase of voltage source with a third phase, say phase C.

A multiphase voltage sources generator (not shown) supplies a first voltage with phase A to node N21, a second voltage with phase B to node N23 and a third voltage with phase C to node N25.

The current paths from node N21 to node N23 are D27-D30-D23 and D27-D28-D22.

The current paths from node N21 to node N25 are D27-D30-D24 and D27-D32-D25.

The current paths from node N23 to node N21 are D29-D32-D26 and D29-D28-D21.

The current paths from node N23 to node N25 are D29-D32-D25 and D29-D30-D24.

The current paths from node N25 to node N21 are D31-D32-D26 and D31-D28-D21.

The current paths from node N25 to node N23 are D31-D28-D22 and D31-D30-D23.

FIGS. 13A to 13D show the twelfth embodiment of the present invention. A power source having a triangle voltage waveform can also be used in the present invention.

Figure 13A:
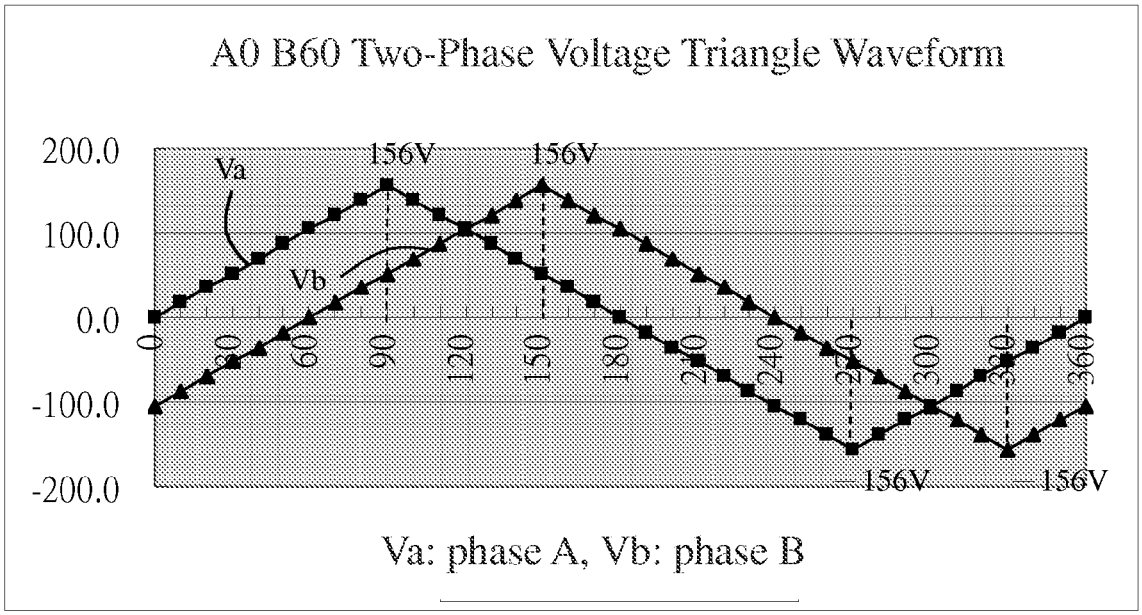
FIGS. 13A to 13D show a twelfth embodiment, an AC_LED driven by a three-phase voltage source.

FIG. 13A shows a voltage waveform with triangle shape. The abscissa shows a voltage phase with a scale of 0~360 degree. The ordinate shows voltage with a scale of −200V~+200V. Curve Va is a first phase voltage source coupling to node Na, and curve Vb is a second phase voltage source coupling to node Nb. The phase of Vb is 60 degree lag than the phase of Curve Va. Curve Va has a positive voltage peak of +156V at phase 90 degree and a negative voltage peak of −156V at phase 270. Curve Vb has a positive voltage peak of +156V at phase 150 degree and a negative voltage peak of −156V at phase 330.

Figure 13B:
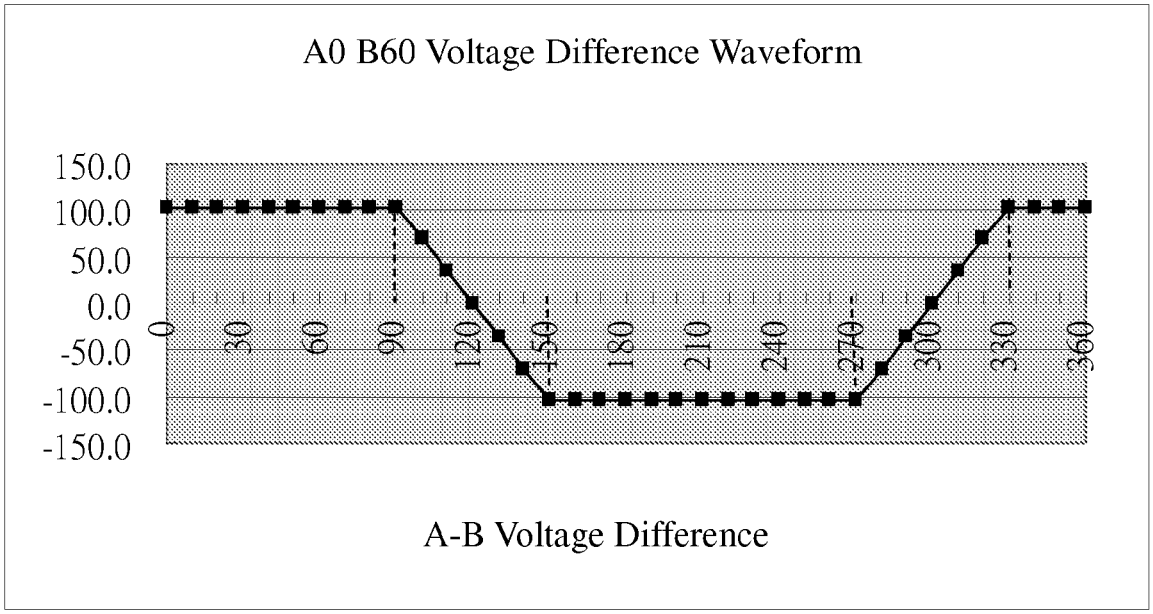

Referring to FIG. 13B, which shows a voltage difference waveform. The abscissa shows voltage phase with a scale of 0~360 degree. The ordinate shows voltage with a scale of −150V~+150V. There is a voltage difference of +100V at phase 40~100 degree. Voltage difference goes linearly downward from +100V to −100V from phase 90 degree to 150 degree. There is a voltage difference of −100V at phase 150~270 degree. Voltage difference goes linearly upward from −100V to +100V from phase 270 degree to 330 degree. There is a voltage difference of +100V at phase 330~360 degree.

Figure 13C:
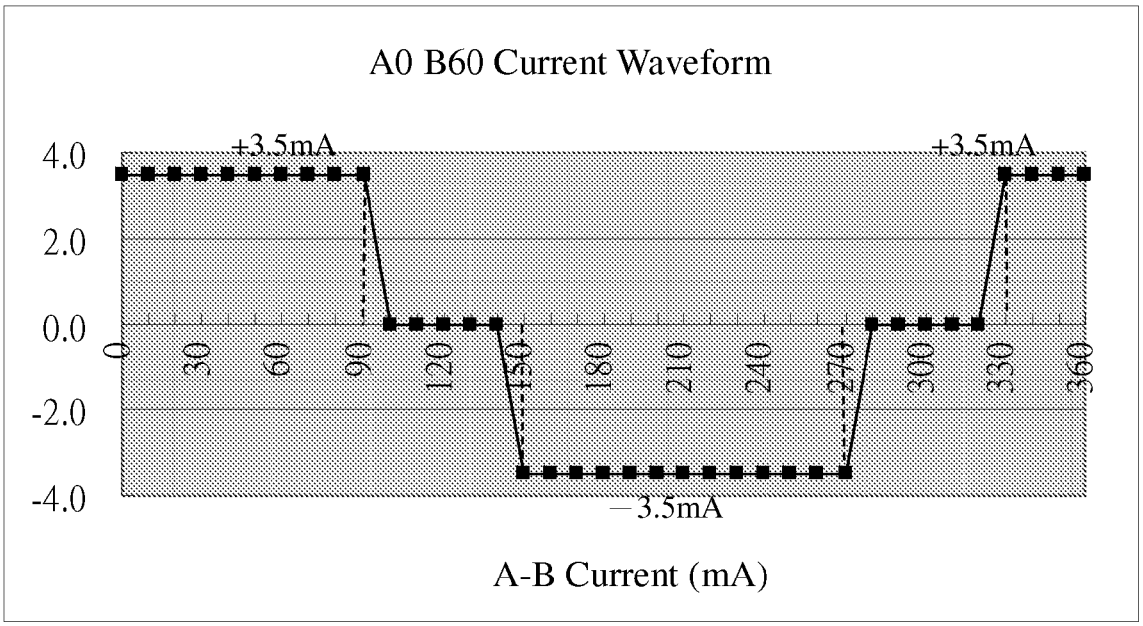

FIG. 13C shows a current waveform. The abscissa shows voltage phase with a scale of 0~360 degree. The ordinate shows current with a scale of −4.0 mA~+4.0 mA. There is a current of +3.5 mA at phase 0~90 degree. There is a current of 0 mA at phase 100~140 degree. The current goes downward from 0 mA to −3.5 mA from phase 140 degree to 150 degree. There is a current −3.5 mA at phase 150~270 degree. The current goes upward from −3.5 mA to 0 mA from phase 270 degree to 280 degree. There is a current of 0 mA at phase 280~320 degree. The current goes upward from 0 mA to +3.5 mA from phase 320 degree to 330 degree. There is a current of +3.5 mA at phase 330~360 degree.

Figure 13D:
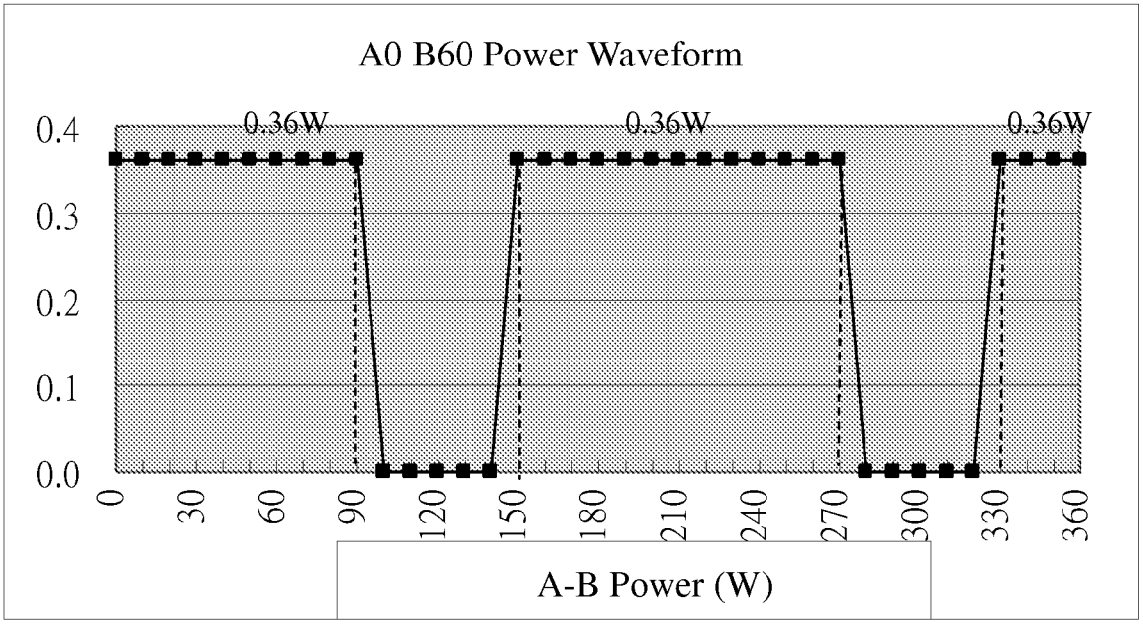

FIG. 13D shows a power waveform. The abscissa shows voltage phase with a scale of 0~360 degree. The ordinate shows power with a scale of 0.0 W~0.4 W. There is a power of 0.36 W at phase 0~90. The power goes downward from 0.36 W to 0 W from phase 90 degree to 100 degree. There is a power of 0 W at phase 100~140 degree. The power goes upward from 0 W to 0.36 W from phase 140 degree to 150 degree. There is a power of 0.36 W at phase 150~270 degree. The power goes downward from 0.36 W to 0 W from phase 270 degree to 280 degree. There is a power of 0 W at phase 280~320 degree. The power goes upward from 0 W to 0.36 W from phase 320 degree to 330 degree. There is a power of 0.36 W at phase 330~360 degree.

FIGS. 14A to 14D show the thirteenth embodiment of the present invention.

Figure 14A:
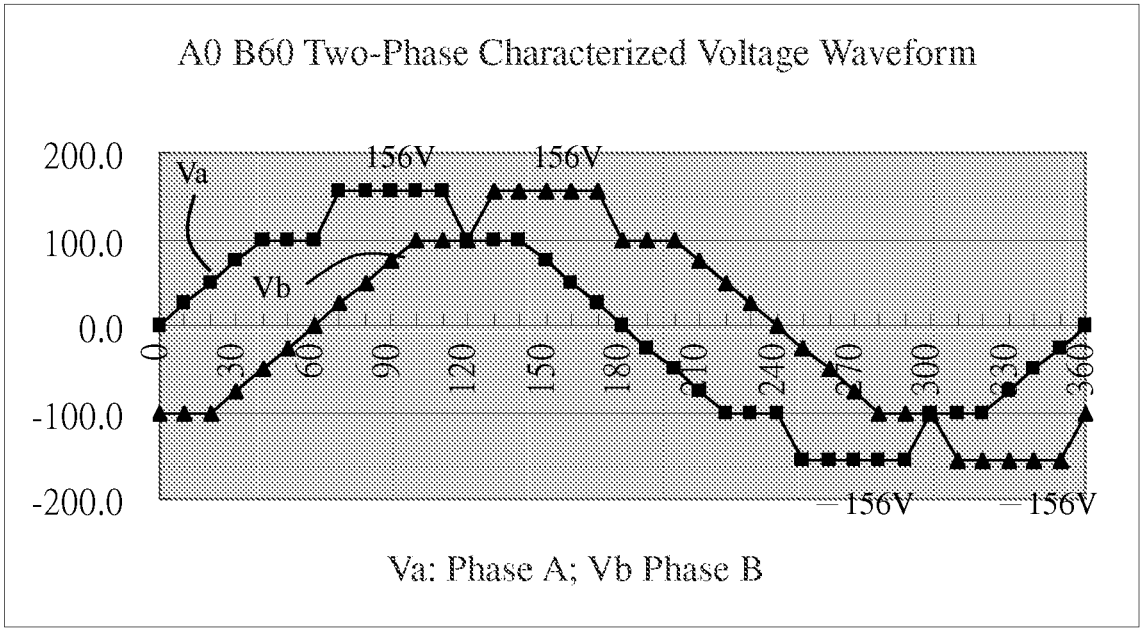
FIGS. 14A to 14D show a thirteenth embodiment, an AC_LED driven by a characterized voltage source.

FIG. 14A shows a voltage waveform of two characterized voltages. A power source having a characterized voltage waveform can also be used in the present invention. The abscissa shows voltage phase with a scale of 0~360 degree. The ordinate shows voltage with a scale of −200V~+200V. There are two characterized waveform Va and Vb with a phase difference of 60 degree with each other. Va has a voltage of +100V at phase 40~60 degree. Va has a voltage of +156V at phase 70~110 degree. Va has a voltage of +100V at phase 120~140 degree. Va has a voltage of 100V at phase 220~240 degree. Va has a voltage of −156V at phase 250~290 degree. Va has a voltage of −100V at phase 300~320 degree. Vb has a voltage of −100V at phase 0~20 degree. Vb has a voltage of +100V at phase 100~120 degree. Vb has a voltage of +156V at phase 130~170 degree. Vb has a voltage of +100V at phase 180~200 degree. Vb has a voltage of −100V at phase 280~300 degree. Vb has a voltage of −156V at phase 310~350 degree.

Figure 14B:
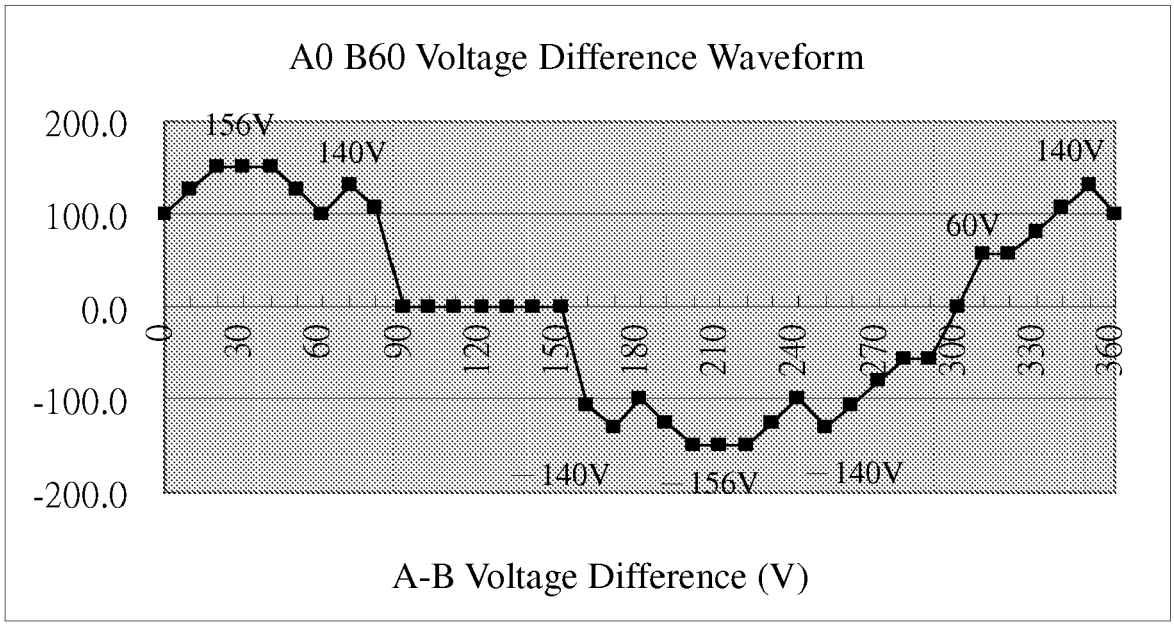

FIG. 14B shows a voltage difference waveform. A power source having a characterized voltage waveform can also be used in the present invention. The abscissa shows voltage phase with a scale of 0~360 degree. The ordinate shows voltage with a scale of −200V~+200V. There is a voltage difference of +156V at phase 20~40 degree. There is a voltage difference of +140V at phase 70 degree. There is a voltage difference of +0V at phase 90~150 degree. There is a voltage difference of −140V at phase 170 degree. There is a voltage difference of −156V at phase 200~220 degree. There is a voltage difference of −140V at phase 250 degree. There is a voltage difference of 60V at phase 280~290 degree. There is a voltage difference of +60V at phase 310~320 degree. There is a voltage difference of +140V at phase 350 degree.

Figure 14C:
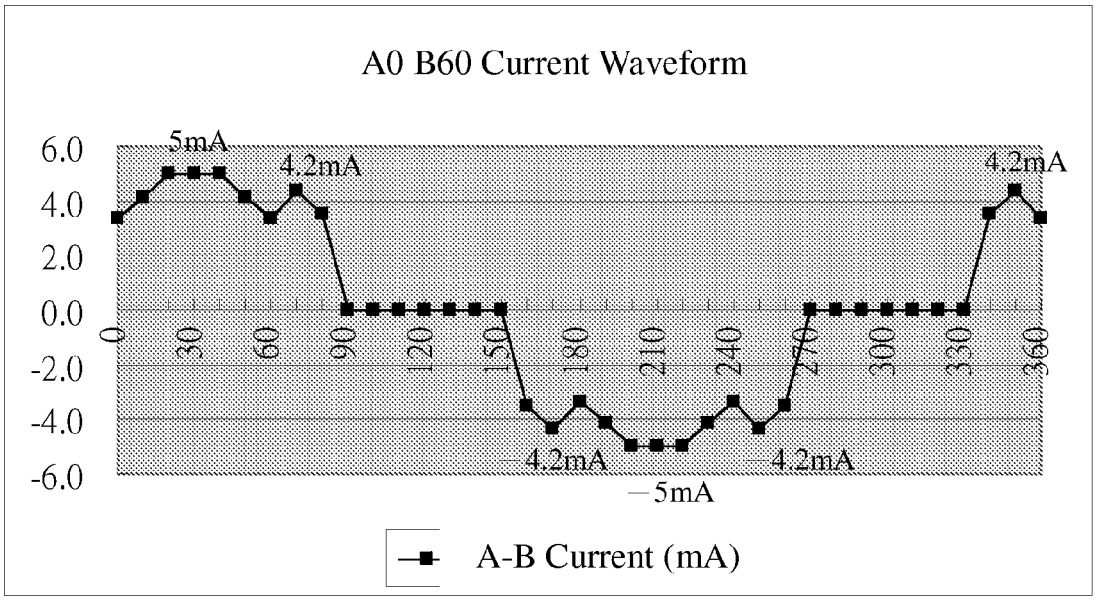

FIG. 14C shows a current waveform. The abscissa shows a voltage phase with a scale of 0~360 degree. The ordinate shows current with a scale of −6.0 mA~+6.0 mA. There is a current of +5 mA at phase 20~40 degree. There is a current of +4.2 mA at phase 70 degree. There is a current of +0 mA at phase 90~150 degree. There is a current of −4.2 mA at phase 170 degree. There is a current of −5 mA at phase 200~220 degree. There is a current of −4.2 mA at phase 250 degree. There is a current of 0 mA at phase 270~330 degree. There is a current of +4.2 mA at phase 350 degree.

Figure 14D:
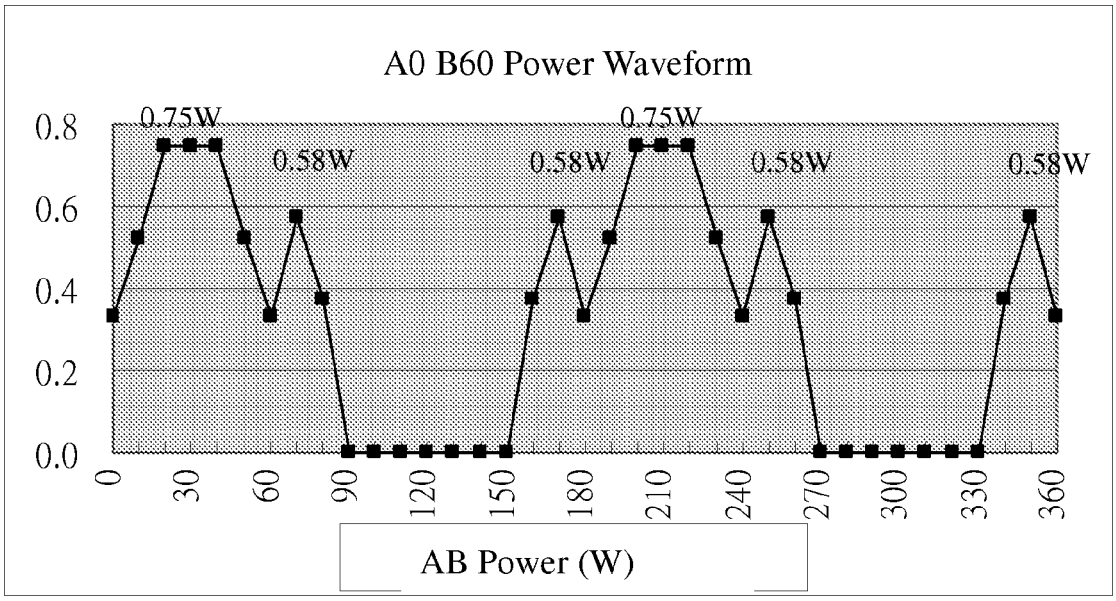

FIG. 14D shows a power waveform. The abscissa shows a voltage phase with a scale of 0~360 degree. The ordinate shows power with a scale of 0.0 W~0.8 W. There is a power of 0.75 W at phase 20~40 degree. There is a power of 0.58 W at phase 70 degree. There is a power of 0 W at phase 90~150 degree. There is a power of 0.58 W at phase 170 degree. There is a power of 0.75 W at phase 200~220 degree. There is a power of 0.58 W at phase 250 degree. There is a power of 0 W at phase 270~330 degree. There is a power of 0.58 W at phase 350 degree.

The multiphase voltage sources controlling system is used to adjust light tensity and/or light color of a lighting system and can be used including but not limited to the following fields: backlight panel, display, neon lamp, or solid lighting lamps. The AC_LED disclosed in the present invention can be implemented with discrete conventional light emitting diodes or can be implemented with a plurality of DC_LEDs integrated in a single chip becoming a single-chip-AC_LED through semiconductor manufacturing process.

While the preferred embodiments has been described by way of example, it will be apparent to those skilled in the art that various modification may be made in the embodiments without departing from the spirit of the present invention. Such modifications are all within the scope of the present invention, as defined by the appended claims.

What is claimed is:

1. A multiphase voltage sources driven AC_LED system, comprising:

a first AC_LED having a first terminal and a second terminal;

a multiphase voltage sources generator generating a first voltage with a first phase coupling to said first terminal and generating a second voltage with a second phase coupling to said second terminal;

a voltage phase controller coupling to said generator for controlling voltage phase of each voltage sources output therefrom; and a feedback circuit having a first terminal and a second terminal, said first terminal coupling to said AC_LED, said second terminal coupling to said voltage phase controller.

2. The multiphase voltage sources driven AC_LED system as claimed in claim 1, further comprising a frequency adjustor coupling to said generator for controlling frequency of each of the voltage sources supplied to said AC_LED.

3. The multiphase voltage sources driven AC_LED system as claimed in claim 1, wherein the feedback circuit comprises a current feedback circuit having a first terminal and a second terminal, said first terminal coupling to each of said output voltage sources from said generator, said second terminal coupling to said voltage phase controller for controlling phase fluctuation limits of each voltage sources supplying to said AC_LED.

4. The multiphase voltage sources driven AC_LED system as claimed in claim 1, wherein the feedback circuit comprises a light feedback circuit having a first terminal and a second terminal, said first terminal coupling to light emission of said AC_LED, said second terminal coupling to said voltage phase controller for controlling the average light intensity or individual color intensity through adjusting the phase difference.

5. The multiphase voltage sources driven AC_LED system as claimed in claim 1, wherein the feedback circuit comprises a temperature feedback circuit having a first terminal and a second terminal, said first terminal coupling to said AC_LED to sense the temperature of the AC_LED, said second terminal coupling to said voltage phase controller to trigger an overheat protection mechanism.

6. The multiphase voltage sources driven AC_LED system as claimed in claim 1, further comprising a second AC_LED having a third terminal and a fourth terminal, said third terminal coupling to said first terminal, said generator generating a fourth voltage coupling to said fourth terminal.

7. The multiphase voltage sources driven AC_LED system as claimed in claim 6, further comprising a third AC_LED having a fifth terminal and a sixth terminal, said fifth terminal coupling to said second terminal, said sixth terminal coupling to said fourth terminal.

8. The multiphase voltage sources driven AC_LED system as claimed in claim 1, further comprising:

a second AC_LED having a third terminal and a fourth terminal; and a third AC_LED having a fifth terminal and a sixth terminal;

wherein said third terminal and said fifth terminal are coupled to said second terminal, and said generator generates voltages supplied to said fourth terminal and said sixth terminal.

9. The multiphase voltage sources driven AC_LED system as claimed in claim 1, further comprising discrete light emitting diodes.

10. The multiphase voltage sources driven AC_LED system as claimed in claim 1, further comprising a plurality of DC_LEDs integrated into a single chip.

11. A multiphase voltage sources driven AC_LED system, comprising:

a first AC_LED, comprising:

a first node N1, a second node N2, a third node N3, a fourth node N4, said first node N1 and said third node N3 electrically coupling to a power source;

a first DC_LED electrically coupling from said first node N1 in forward direction to said second node N2;

a second DC_LED electrically coupling from said second node N2 in backward direction to said third node N3;

a third DC_LED electrically coupling from said third node N3 in backward direction to said fourth node N4;

a fourth DC_LED electrically coupling from said fourth node N4 in forward direction to said first node N1; and a fifth DC_LED electrically coupling from said second node N2 in forward direction to said fourth node N4;

a multiphase voltage sources generator supplying a first voltage source having a first phase to said first node N1, and supplying a second voltage source having a second phase to the third node N3;

a voltage phase controller coupling to said generator for controlling voltage phase of each voltage sources output therefrom; and a feedback circuit having a first terminal and a second terminal, said first terminal coupling to said AC_LED, said second terminal coupling to said voltage phase controller.

12. The AC_LED as claimed in claims 11, wherein said DC_LED is a discrete element.

13. The AC_LED as claimed in claims 11, wherein said DC_LED is disposed in a semiconductor chip.

14. A driven AC_LED formed with twelve DC_LEDs, comprising:

a first node N1, a second node N2, a third node N3, a fourth node N4, a fifth node N5, a sixth node N6, a seventh node N7, wherein said first node N1, said third node N3, and said fifth node N5 are coupled to a power source;

a first DC_LED coupling from said first node N1 in backward direction to said second node N2;

a second DC_LED coupling from said second node N2 in forward direction to said third node N3;

a third DC_LED coupling from said third node N3 in backward direction to said fourth node N4;

a fourth DC_LED coupling from said fourth node N4 in forward direction to said fifth node N5;

a fifth DC_LED coupling from said fifth node N5 in backward direction to said sixth node N6;

a sixth DC_LED coupling from said sixth node N6 in forward direction to said first node N1;

a seventh DC_LED coupling from said seventh node N7 in backward direction to said first node N1;

an eighth DC_LED coupling from said seventh node N7 in forward direction to said second node N2;

a ninth DC_LED coupling from said seventh node N7 in backward direction to said third node N3;

a tenth DC_LED coupling from said seventh node N7 in forward direction to said fourth node N4;

an eleventh DC_LED coupling from said seventh node N7 in backward direction to said fifth node N5; and a twelfth DC_LED coupling from said seventh node N7 in forward direction to said sixth node N6.

15. A light timing controlling method for an AC_LED, comprising the steps of:

preparing an AC_LED having a first terminal and a second terminal;

preparing a multiphase voltage sources generator to generate a first voltage with a first phase and a second voltage with a second phase;

preparing a voltage phase controller to control said generator for controlling voltage phase of each voltage sources output therefrom;

preparing a feedback circuit having a first terminal and a second terminal;

coupling said first terminal of the feedback circuit to the AC_LED; and coupling said second terminal of the feedback circuit to said voltage phase controller;

coupling said first voltage to said first terminal of the AC_LED; and coupling said second voltage to said second terminal of the AC_LED.

16. The light timing controlling method for an AC_LED as claimed in claim 15, wherein said AC_LED further comprises a third terminal and couples a third voltage source with a third phase to said third terminal.

17. The light timing controlling method for an AC_LED as claimed in claim 16, wherein said AC_LED further comprises a fourth terminal and couples a fourth voltage source with a fourth phase to said fourth terminal.

18. The light timing controlling method for an AC_LED as claimed in claim 15, further comprising the step of changing frequency of each of said voltage sources.

19. The light timing controlling method for an AC_LED as claimed in claim 15, wherein said voltage having a waveform selected from the group consisting of a sine waveform, a triangle waveform, and a characterized waveform.

* * * * *